US005398099A

United States Patent [19]

Nagamochi et al.

[11] Patent Number: 5,398,099

[45] Date of Patent: Mar. 14, 1995

[54] IMAGE FORMING APPARATUS WITH BIAS MEANS FOR PREVENTING TONER PARTICLES FROM CLOUDING OPTICAL COMPONENTS

[75] Inventors: Katsuya Nagamochi, Tokyo; Rintaro Nakane, Yokohama, both of Japan

[73] Assignee: Kabushiki Kaisha Toshiba, Kawasaki, Japan

[21] Appl. No.: 35,954

[22] Filed: Mar. 23, 1993

[30] Foreign Application Priority Data

Sep. 24, 1992 [JP] Japan ..... 4-277700

[51] Int. Cl.[6] ..... G03G 21/00

[52] U.S. Cl. ..... 355/204; 355/215

[58] Field of Search ..... 355/215, 237, 245, 246, 355/208, 204

[56] References Cited

U.S. PATENT DOCUMENTS

| | | | |
|---|---|---|---|
| 3,481,669 | 12/1969 | Roth et al. . | |
| 4,277,162 | 7/1981 | Kasahara et al. | 355/208 |
| 4,318,610 | 3/1982 | Grace | 355/246 |
| 4,550,998 | 11/1985 | Nishikawa | 355/246 X |
| 4,646,249 | 2/1987 | Tanioka et al. . | |
| 4,789,878 | 12/1988 | Endo et al. . | |
| 4,796,065 | 1/1989 | Kanbayashi . | |
| 4,870,460 | 9/1989 | Harada et al. | 355/246 |
| 4,975,747 | 12/1990 | Higuchi | 355/246 |
| 5,083,160 | 1/1992 | Suzuki et al. | 355/208 |
| 5,099,279 | 3/1992 | Shimizu | 355/208 |
| 5,107,302 | 4/1992 | Bisaiji | 355/246 |
| 5,270,784 | 12/1993 | Nakane et al. | 355/246 |
| 5,276,481 | 1/1994 | Kinoshita et al. | 355/246 X |

FOREIGN PATENT DOCUMENTS

| | | |
|---|---|---|
| 0520144 | 12/1992 | European Pat. Off. . |
| 1522683 | 10/1969 | Germany . |
| 58-198056 | 11/1983 | Japan . |
| 62-124664 | 6/1987 | Japan . |
| 63-123065 | 5/1988 | Japan . |

*Primary Examiner*—A. T. Grimley
*Assistant Examiner*—Nestor R. Ramirez
*Attorney, Agent, or Firm*—Foley & Lardner

[57] ABSTRACT

An image forming apparatus includes a conductive transparent member arranged between a photoconductive drum and a laser optical system for exposing the drum. The transparent member is electrically connected to a bias voltage power supply. In reversal development, the bias voltage power supply supplies the transparent member with a voltage ranging from a charging voltage to a developing voltage so as to generate an electric field between the transparent member and the drum. In normal development, the power supply supplies the transparent member with a voltage ranging from the developing voltage to ground so as also to generate an electric field between the transparent member and the drum.

7 Claims, 16 Drawing Sheets

IMAGE FORMING APPARATUS WITH BIAS MEANS FOR PREVENTING TONER PARTICLES FROM CLOUDING OPTICAL COMPONENTS

BACKGROUND OF THE INVENTION

1. Field of the Invention

The present invention relates to an image forming apparatus, such as an electrophotographic printer, a copying machine, or the like.

2. Description of the Related Art

There are known some image forming apparatuses, such as a printer and a copying machine which have a measurement device for measuring the amount of toner deposited on an image carrier, so as to correctly compensate, for image density change under the influence of environmental changes, secular changes, and the like. Such a measurement device has a light source for emitting a light beam to an image carrier, and which receives the reflected beam from the image carrier to measure an amount of toner deposited on the image carrier. In such a measurement device, toner particles scattered from the image carrier may be attached to optical members of the device, such as a cover glass or a lens adjacent to the image carrier. Accurate measurements cannot be performed when the toner particles are attached to the optical members.

Not only in the measuring device for measuring the amount of toner, but also in devices, such as a laser optical system, a solid-state scanning head, and the like, which have a light-emitting unit and a light-receiving unit, scattered toner particles may be attached to optical members, such as an exposure mirror, a cover glass, or a lens, which are arranged in the optical path of the device, and a change in exposure amount or the scattering of emitted light occurs. In this case, the device cannot operate correctly, and it is difficult to form accurate images.

SUMMARY OF THE INVENTION

The present invention has been made in consideration of the above circumstances, and its object is to 10 provide an image forming apparatus capable of preventing normally and reversely charged toner particles of both polarities from being attracted any optical means such as a toner deposition amount measuring device or an exposure optical system, thereby properly forming an image.

In order to achieve the above object, according to the present invention, there is provided an image forming apparatus comprising: a conductive transparent means arranged between an image carrier and an optical means for radiating a light beam on an image carrier; and applying means for applying a voltage ranging from a charging voltage to a developing bias voltage to the conductive transparent means in reversal development and for applying a voltage ranging from the developing bias voltage to ground to the conductive transparent means in normal development.

In the image forming apparatus according to the present invention, the conductive transparent means is electrically connected to a charging voltage source or a developing bias voltage source in reversal development, and the conductive transparent means is electrically connected to ground or the developing bias voltage source in normal development.

In reversal development, a voltage ranging from the charging voltage to the developing bias voltage is applied to the conductive transparent means to generate an electric field between the image carrier and the conductive transparent means, and the electric field prevents the scattered developing agent from attaching to the conductive transparent means. In the normal development, a voltage ranging from the developing bias voltage to ground is applied to the conductive transparent means to generate an electric field between the image carrier and the conductive transparent means, and the electric field prevents the scattered developing agent from attaching to the conductive transparent means.

Therefore, both the normally charged developing agent and the reversely charged developing agent can be prevented from being attached to the optical means, thereby enabling proper images to be formed.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

BRIEF DESCRIPTION OF THE DRAWINGS

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 10 show a color laser printer according to an embodiment of the present invention, in which:

FIG. 1 is a sectional view showing the color laser printer,

FIG. 2 is a block diagram showing a charger, an exposure unit, a developing unit, and a control circuit thereof in the color laser printer, FIG. 3 is a sectional view showing a toner deposition amount measuring device, FIG. 4 is a block diagram showing the arrangement of the toner deposition amount measuring unit, FIG. 5 is a schematic view showing the relationship between the surface potential of a photoconductive drum and the potential of toner in reversal development, FIG. 6 is a schematic view showing a relationship between the surface potential of the photoconductive drum and the potential of the toner in normal development, FIG. 7 is a schematic view showing a relationship between the surface potential of the photoconductive drum and an application voltage in reversal development, FIG. 8 is a schematic view showing the relationship between the surface potential of the photoconductive drum and an application voltage in normal development, FIG. 9 is a timing chart showing timings at which voltages are applied to the charger, a conductive transparent member of an exposure optical system, the developing unit, the conductive transparent member of a measuring device, and a transfer charger, and FIG. 10 is a schematic view showing a connection between a power supply and the conductive transparent members;

DETAILED DESCRIPTION OF THE PREFERRED EMBODIMENTS

An embodiment of the present invention will be described below with reference to the accompanying drawings.

Figure 1:
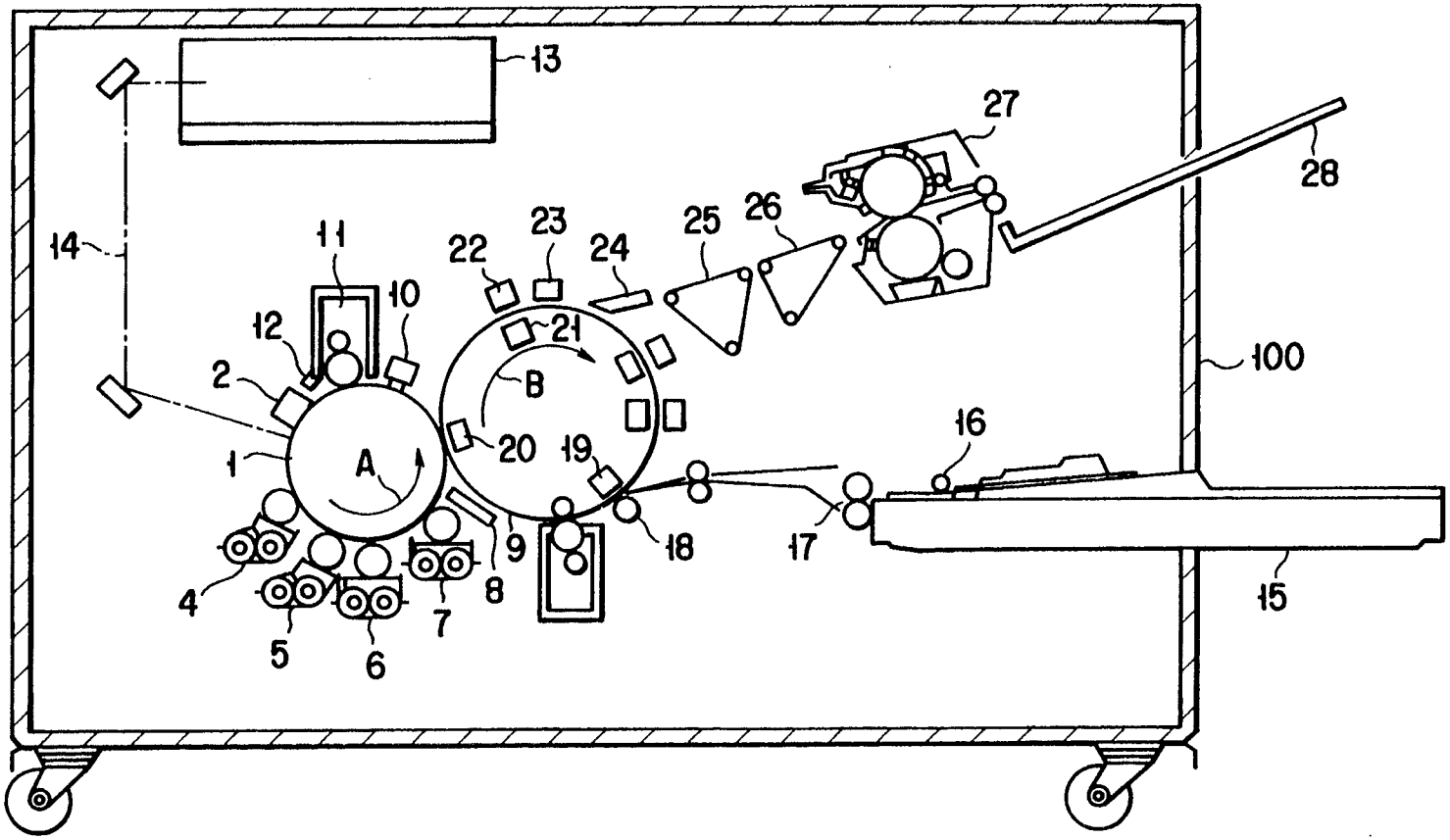

FIG. 1 shows an embodiment in which an image forming apparatus according to the present invention is applied to a color laser printer. A photoconductive drum 1 serving as an image carrier rotatable in counterclockwise direction (the direction of an arrow A indicated in FIG. 1) is arranged at a substantially central portion of a main body 100 of the color laser printer. A charger 2 serving as charging means, first to fourth developing units 4, 5, 6, and 7 serve as developing means. A toner deposition amount measurement device 8 serves as a reflected light amount measuring means, for measuring an amount of toner deposited on the photoconductive drum 1, a transfer drum 9, a cleaning predischarger 10, a cleaner 11, and a discharge lamp 12 are sequentially arranged around the drum 1.

The photoconductive drum 1 is rotated in the direction of the arrow A in FIG. 1, and the surface of the photoconductive drum 1 is uniformly charged by the charger 2. Between the charger 2 and the first developing unit 4, a laser beam 14 emitted from a laser optical system 13, serving as exposure means is radiated on the surface of the photoconductive drum 1 to form a latent image corresponding to image data on the drum 1.

The first to fourth developing units 4 to 7 develop latent images, corresponding to colors, on the photoconductive drum 1. For example, the first developing unit 4 develops a latent image corresponding to magenta, the second developing unit 5 develops a latent image corresponding to cyan, the third developing unit 6 develops a latent image corresponding to yellow, and the fourth developing unit 7 develops a latent image corresponding to black.

A transfer paper serving as a transfer medium is fed from a sheet feeding cassette 15 by sheet feeding rollers 16, temporarily registered by resist rollers 17, and supplied to a predetermined position of the transfer drum 9. The transfer paper is electrostatically attracted to the outer surface of the transfer drum 9 by an attraction roller 18 and an attraction charger 19. The transfer paper attracted to the transfer drum 9 is conveyed in accordance with the clockwise rotation of the transfer drum 9 (the direction of an arrow B shown in FIG. 1).

The developed toner image on the photoconductive drum 1 is transferred to the transfer paper by a transfer charger 20 at a position where the photoconductive drum 1 and the transfer drum 9 are opposite to each other. When multicolor printing is to be performed, a cycle in which one rotation of the transfer drum 9 is regarded as one period is performed many times while the developing units are switched, and a plurality of color toner images are transferred to the transfer paper in a plurality of cycles.

The transfer paper to which the toner image is transferred is further conveyed by means of the rotation of the transfer drum 9, and it is discharged by an internal discharger 21, an external discharger 22, and a separation discharger 23, and is separated from the transfer drum 9 by separation grippers 24. The separated transfer paper is conveyed to a fixing unit 27 by conveying belts 25 and 26. The toner on the transfer paper is heated by the fixing unit 27 and melted. Immediately after the transfer paper is delivered from the fixing unit 27, the toner is fixed onto the transfer paper, and the transfer paper on which the toner image is fixed is delivered to a tray 28.

Figure 2:
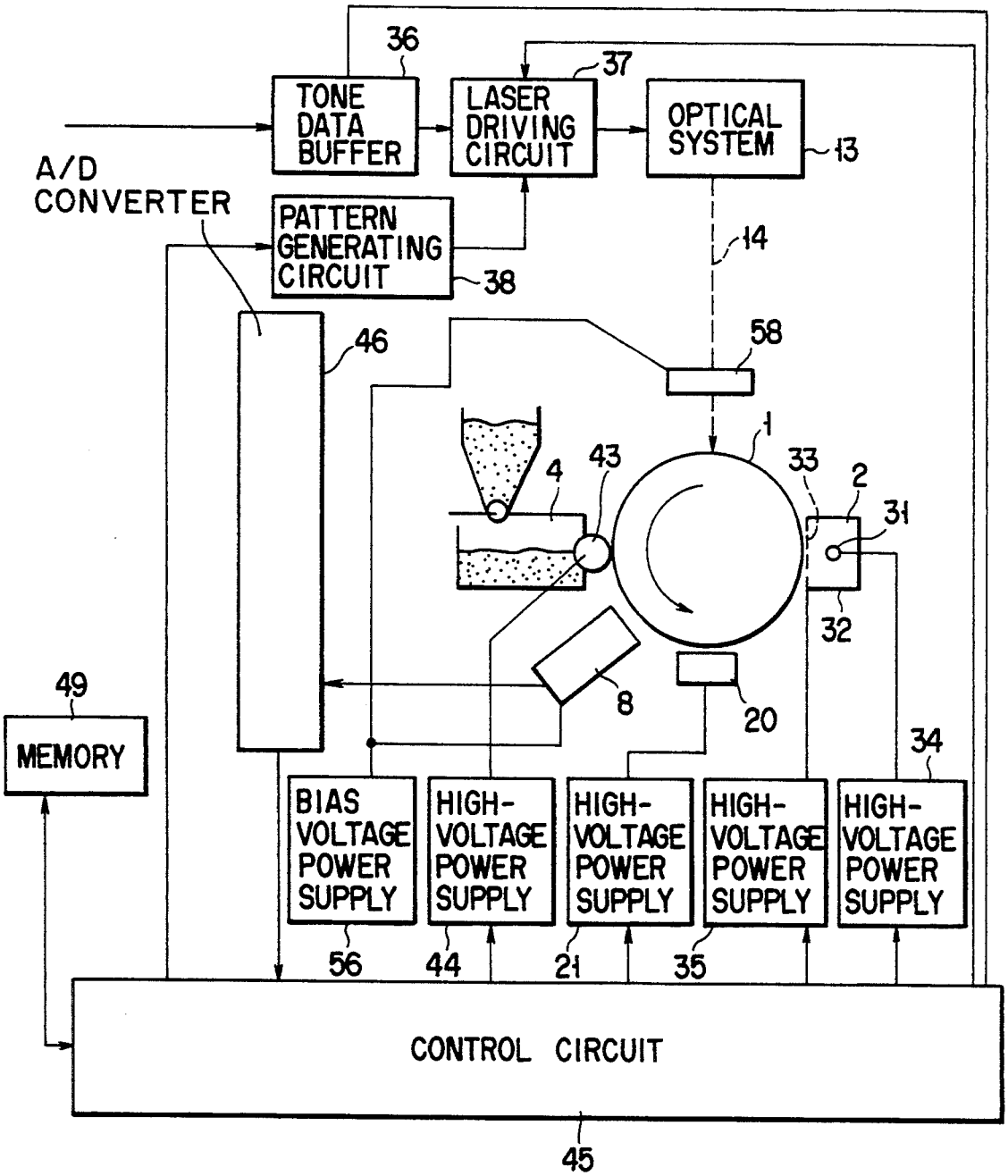

FIG. 2 is a block diagram showing the charger, the exposure unit, the developing units, and a control circuit thereof in the color laser printer having the above arrangement. The arrangement and operation of the color laser printer will be described in detail using FIG. 2.

The photoconductive drum 1 is rotated counterclockwise. As the charger 2, a non-contact type charger mainly comprising a charge wire 31, a conductive case 32, and a grid electrode 33 is used. The charge wire 31 is connected to a high-voltage power supply 34 for corona discharge, and the charge wire 31 performs corona discharging to the surface of the photoconductive drum 1 to charge the surface. The grid electrode 33 is connected to a grid bias high-voltage power supply 35, and a charge amount on the surface of the photoconductive drum 1 is determined by a grid bias voltage. In addition, the high-voltage power supplies 34 and 35 are connected to a control circuit 45, and their output voltages are controlled by the control circuit 45.

The surface of the photoconductive drum 1 uniformly charged by the charger 2 is exposed with the modulated laser beam 14 from the laser optical system 13 so that a latent image is formed on the drum surface. A tone data buffer 36 stores tone data from external equipment or a controller (neither are shown), compensates the tone characteristics of the printer, and converts the data into laser exposure time data (pulse width). A laser driving circuit 37 modulates a laser driving current (emission time) in accordance with the laser exposure time data from the tone data buffer 36 under the control of the control circuit 45 such that the laser driving current is synchronized with a scanning position of the laser beam 14. A semiconductor laser oscillator (not shown) in the laser optical system 13 is driven by the modulated laser driving current. In this manner, the semiconductor laser oscillator performs an emission operation in accordance with the exposure time data.

In addition, the laser driving circuit 37 compares an output from a monitor light-receiving element (not shown) in the laser optical system 13 with a set value and controls a driving current such that an output light amount from the semiconductor laser oscillator is kept to be the set value.

On the other hand, a pattern generating circuit 38 generates tone data for a test pattern of the printer itself and for a pattern for measuring an amount of deposited toner under the control of the control circuit 45, and transmits the tone data to the laser driving circuit 37.

In this case, the control circuit 45 switches the laser exposed time data from the tone data buffer 36 and the tone data, of the pattern for measuring the amount of deposited toner, from the pattern generating circuit 38. Data selected by the control circuit 45 is transmitted to the laser driving circuit 37.

The photoconductive drum 1 on which the latent image is formed is subjected to development by the developing units. Although the color laser printer according to this embodiment has the four developing units 4, 5, 6, and 7 as described above, only the developing unit 4 will be described. A developing roller 43 of the first developing unit 4 is mainly formed of a conductive material, is connected to a developing bias high-voltage power supply 44, and is rotated while being applied with the developing bias voltage. For this reason, the developing roller 43 deposits the toner to the latent image on the photoconductive drum 1. The developed toner image in an image forming region is transferred to a transfer paper supported and conveyed by the transfer drum 9. The transfer charger 20 is connected to an internal discharger (high-voltage power supply) 21. By applying a voltage having a bias with a polarity opposite to those of the grid bias voltage and the developing bias voltage to the transfer paper, the transfer charger 20 transfers the toner image onto the transfer paper. Note that the high-voltage power supplies 44 and 21 are connected to the control circuit 45, and the developing bias voltage and the transfer bias voltage are controlled by the control circuit 45.

When a non-image forming region of the photoconductive drum 1 on which no latent image is formed reaches the exposure section, the control circuit 45 converts the laser beam exposure time data supplied from the tone data buffer 36 to the laser driving circuit 37 into the tone data supplied from the pattern generating circuit 38 to the laser driving circuit. Thus, a tone pattern for measuring an amount of deposited toner is exposed in the non-image forming region on the photoconductive drum 1, and the exposed portion is developed to form a measuring tone pattern on the drum 1. When the tone pattern reaches a position opposite to the measuring device 8, the measuring device 8 measures an amount of toner deposited to the photoconductive drum 1. The arrangement of the measuring device 8 is described later.

The output (measurement value) from the measuring device 8 is converted into digital signals by an A/D converter 46 and supplied to the control circuit 45. The control circuit 45 compares the output from the measuring device 8 with a predetermined reference value of an amount of deposited toner stored in a memory 49. In accordance with the comparison result, the control circuit 45 converts at least one of the grid bias voltage of the charger 2, the developing bias voltage of the developing unit 4, the exposure amount of the laser optical system 13, the toner density of the developing agent, the emission time of area tone, and the like, which are conditions for forming an image.

In addition, the control circuit 45 performs various control operations, i.e., a switching operation between the tone data from external equipment or a controller (neither are shown), the test pattern for the printer itself, and the pattern tone data for measuring an amount of deposited toner; a receiving operation of an output from the toner deposition amount measuring device 8; the control of outputs from the high-voltage power supplies 21, 34, 35, and 44; a presetting operation of the target value of the laser driving current and the target value of the toner density; a control operation of toner replenishment; correction processing of the tone characteristics of the printer in accordance with tone data; and the like. Further, the memory 49 in which a storage content can be updated is connected to the control circuit 45. The memory 49 stores the reference value of the amount of deposited toner, and the like.

Figure 3:
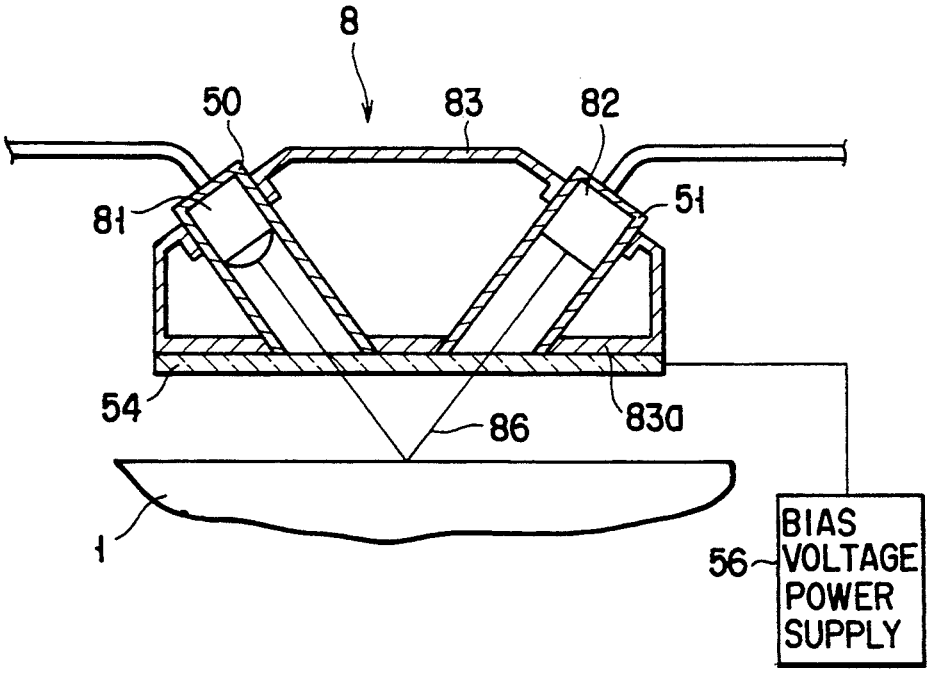
Figure 4:
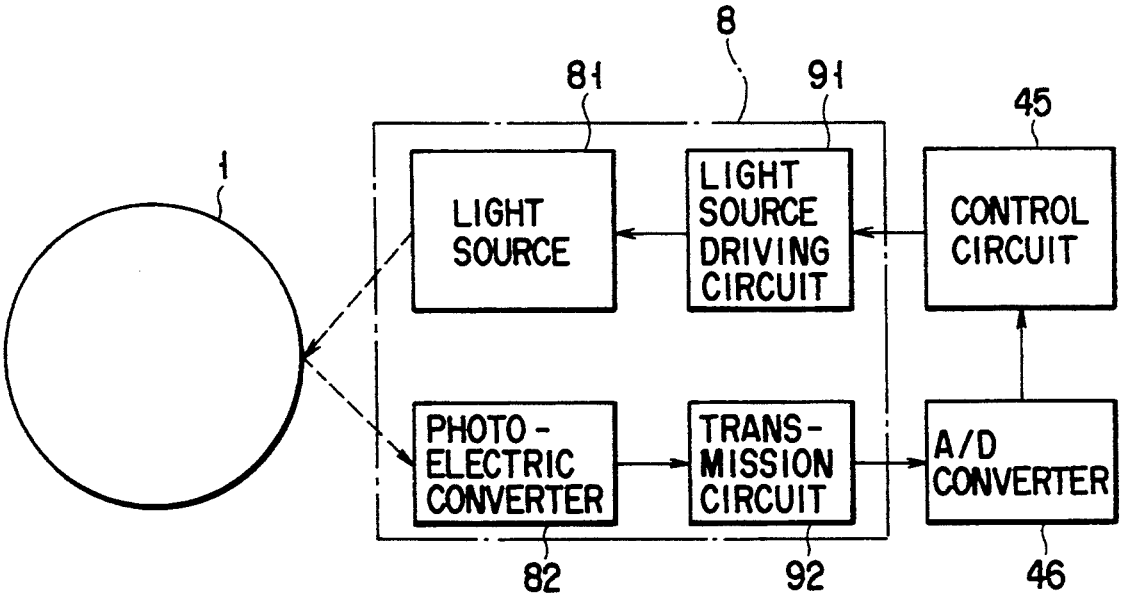

The arrangement and operation of the toner deposition amount measuring device 8 will be described with reference to FIGS. 3 and 4. The measuring device 8 is arranged between the first developing unit 4 and the transfer charger 20 and faces the photoconductive drum 1. The measuring device 8 has a box-like main body 83 formed substantially of an insulating material, and a pair of support sleeves 50 and 51 formed substantially of an insulating material are fixed on the main body. The main body 83 has a bottom wall 83*a* opposite to the photoconductive drum 1, with a predetermined interval. A pair of through holes are formed in the bottom wall 83*a*. Each of the support sleeves 50 and 51 has a closed upper end, and lower ends of the support sleeves 50 and 51 are fitted in the through holes and opened toward the photoconductive drum 1, respectively. A light source 81 such as an LED is arranged in the support sleeve 50 and connected to a driving circuit 91. In addition, a photoelectric converter 82 is arranged in the support sleeve 51 and is connected to a transmission circuit 92. The support sleeves 50 and 51 are arranged at a predetermined angle such that light beam emitted from the light source 81 is incident on the surface of the photoconductive drum 1 through the through hole, is reflected on the surface of the drum 1, and is incident on the photoelectric converter 82 through the through hole.

A plate-like conductive transparent member 54 having the same size as that of the bottom wall 83*a* is fixed to the lower surface of the bottom wall 83*a* of the main body 83, and closes the through holes formed on the bottom wall. The conductive transparent member 54 is connected to a bias power supply 56. As will be described later, when a predetermined voltage is applied from the bias power supply 56 to the conductive transparent member 54, an electric field is generated between the conductive transparent member and the surface of the photoconductive drum 1. When toner particles scattered from the photoconductive drum 1 or the like enter the electric field, the toner particles are subjected to the force applied from outside the electric field. For this reason, the scattered toner particles do not attach to the conductive transparent member 54, the light source 81 of the measuring device 8, and the photoelectric converter 82. In this case, since the light source 81 and the photoelectric converter 82 are supported by the insulating main body 83 and the support sleeves 50 and 51, neither of them is influenced by the high voltage applied to the conductive transparent member 54.

The light beam emitted from the light source 81 is radiated onto the surface of the photoconductive drum 1 through an optical path 86, and reflected by the surface of the drum 1 or toner deposited onto the surface. The reflected light beam reaches the photoelectric converter 82 through the optical path 86, is converted into a current corresponding to the amount of the reflected light beam by the photoelectric converter 82, and is then converted into a voltage. The voltage is transmitted to the A/D converter 46 by the transmission circuit 92 and converted into a digital signal. The digital signal is supplied to the control circuit 45. In addition, the driving circuit 91 for driving the light source 81 is turned on or off by the control circuit 45, or it is controlled in response to a signal for adjusting the amount of driving current supplied to the light source 81.

As shown in FIG. 2, a conductive transparent member 58 is arranged at the output end of the optical path of the laser optical system 13 and opposite and adjacent to the photoconductive drum 1. The conductive transparent member 58 is connected to the bias power supply 56, and a predetermined voltage is applied from the bias power supply 56 to the conductive transparent member 58, as for the conductive transparent member 54. The voltage application generates an electric field between the conductive transparent member 58 and the surface of the photoconductive drum 1. The electric field prevents scattered toner particles from depositing onto the conductive transparent member 58. Therefore, toner does not attach to optical members such as a mirror and a lens arranged in the optical path of the laser optical system 13.

A developing process in the color laser printer having the above arrangement will be described.

Generally, the surface potential of the photoconductive drum 1 charged by the charger 2 is a potential V0 at a non-exposed region, and the potential is changed to a potential VL at an exposed portion exposed by the laser optical system 13. The developing bias voltage VD applied to the developing roller 43 of the first developing unit 4 is set an intermediate value between the potential V0 and the potential VL.

Figure 5:
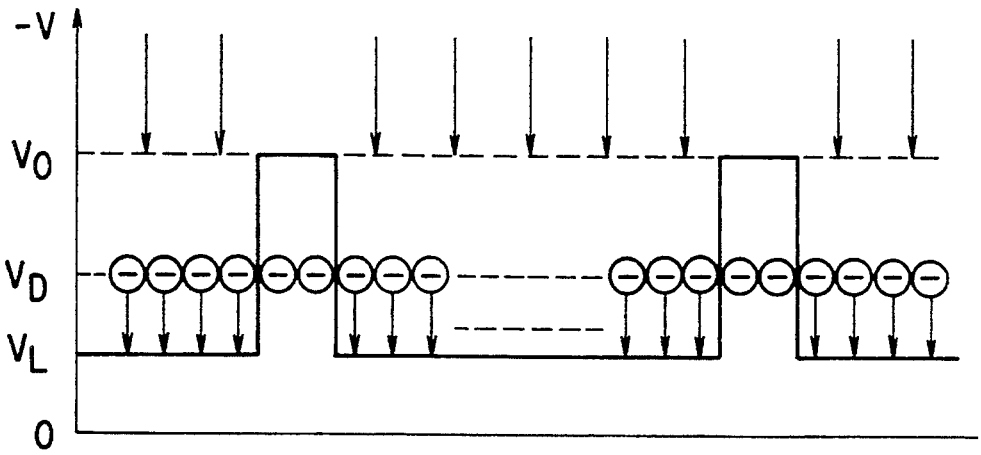

FIG. 5 shows a relationship between the potential of the photoconductive drum 1 and the potential of toner when reversal development is performed. In the reversal development, the toner is negatively charged with reference to the developing bias voltage YD. For this reason, the toner tends to move to a position having a potential such as the potential VL which is closer to 0 V than the potential VD, and not to move to a position having a potential such as the potential V0 which is more negative than the potential VD. Therefore, by using the developing unit 4, on the surface of the photoconductive drum 1, the toner is deposited onto the exposed region whose surface potential falls between the developing bias voltage VD and the potential VL by exposure, thereby being developed.

Figure 6:
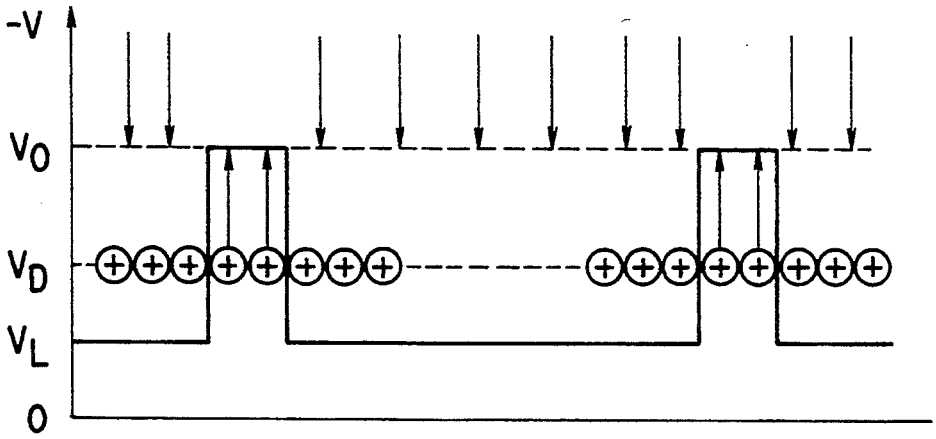

On the other hand, FIG. 6 shows a relationship between the potential of the drum surface and the potential of toner when normal development is performed. In the normal development, the toner is positively charged, with reference to the developing bias voltage VD. For this reason, the toner tends to move to a position having a potential such as the potential V0 which is further from 0 V than is potential VD, and not to move to a position having a potential such as the potential VL which is closer to 0 V than the potential VD. Therefore, by using the developing unit 4, in the surface of the photoconductive drum 1, the toner is deposited onto the non-exposed region whose surface potential falls between the developing bias voltage VD and the potential V0 by exposure, thereby being developed.

A relationship between the surface potential of the photoconductive drum 1 and a voltage VCG applied to the conductive transparent members 54 and 58 in reversal and normal development will be described.

Figure 7:
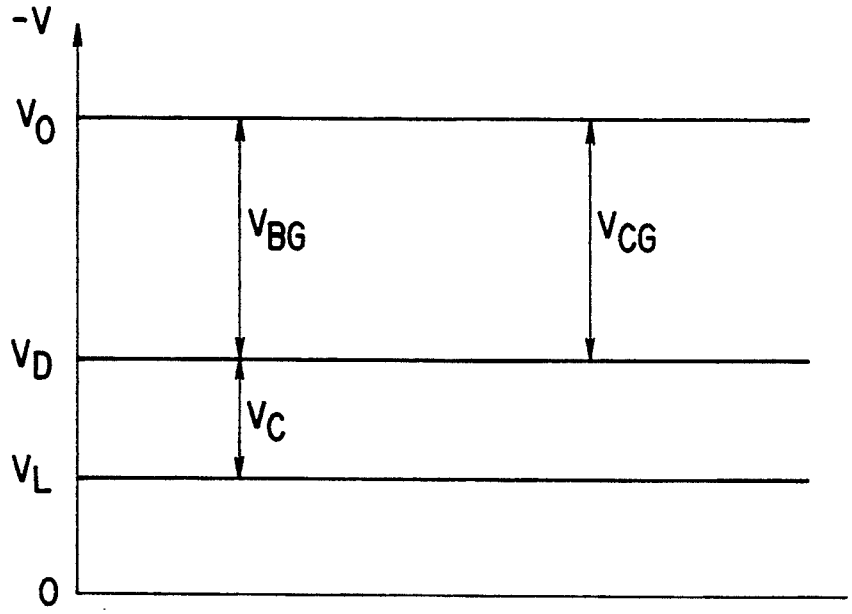

As shown in FIG. 7, in the reversal development, a difference (V0−VD) between the potential V0 of the non-exposed region and the developing bias voltage VD is set to be a background potential VBG, and a difference (VD−VL) between the developing bias voltage VD and the potential VL of the exposed region is set to be a contrast potential VC.

In the reversal development, the developing bias voltage VD falls within the range of $V0 \geqq VD \geqq VL$, a negatively charged toner tends to deposit to a portion on the potential VC side. Therefore, when a voltage VCG applied to the conductive transparent members 54 and 58 is set within the range of the potential VBG (V0 to VD), the toner can be prevented from attaching to the conductive transparent members.

In general, when a latent image on the photoconductive drum 1 is to be developed, in the reversal development, bias values are set such that neither negative charged toner which is normally used or positive charged toner attach to the region having a potential between the developing bias voltage and the potential of the non-exposed region. Because when the toner is attached to the above-mentioned region, fog occurs in a printed matter or copied matter. For this reason, it is found that scattered toner particles do not attach to the region supplied with the bias voltage ranging from the potential of the non-exposed region to the developing bias voltage. Therefore, in the reversal development, when the application voltage VCG is set within the range of $V0 \geqq VCG \geqq VD$, all the scattered toner particles can be prevented from being attached to the conductive transparent members 54 and 58.

Figure 8:
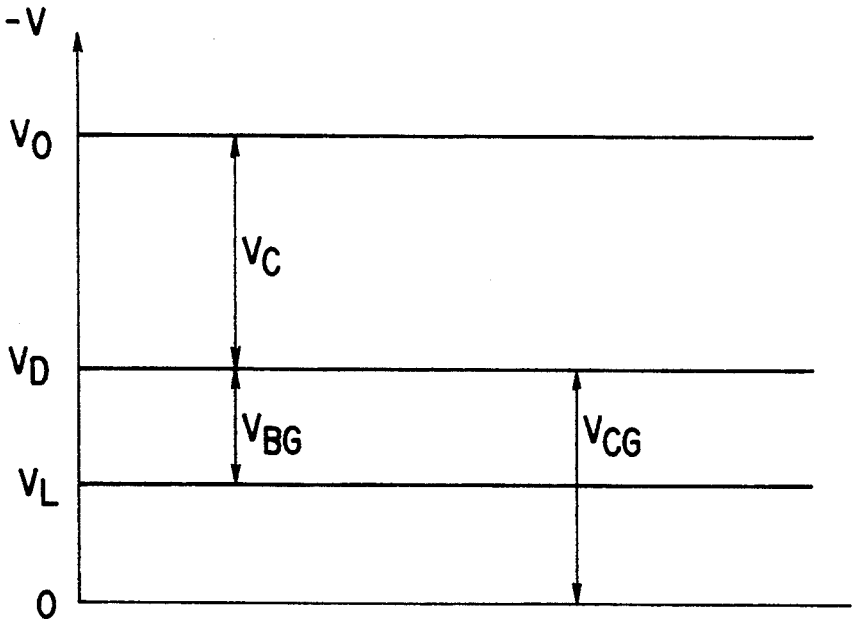

As shown in FIG. 8, although a relationship between the potential of the photoconductive drum 1 and the potential of the toner in the normal development is the same as that in the reversal development, a relationship between the contrast potential and the background potential is reversed, i.e., the potential of V0−VD is set to be the contrast potential VC and the potential VD−VL is set to be the background potential VBG. The developing bias voltage VD falls within the range of V0≧VD≧VL.

However, in the normal development, positively charged toner particles tend to be attached to a region on the potential VC side, and the toner can be prevented from becoming attached to a region to which a potential on the potential VBG side is applied.

In general, when a latent image on the photoconductive drum 1 is to be developed, in normal development, bias values are set such that neither negatively charged toner which is normally charged and positively charged toner are attracted to a region having a potential between the developing bias voltage and the potential of the exposed portion or ground (0 V). Because when the toner is attached to the above-mentioned region, fog occurs in a printed matter or copied matter. For this reason, it is found that scattered toner particles do not attached to the region applied with the bias voltage ranging from the developing bias voltage to the potential of the exposed portion or ground (0 V). Therefore, in the normal development, when the application voltage VCG is set within the range of VD≧VCG≧0 V, all the scattered toner particles can be prevented from being attached to the conductive transparent members 54 and 58.

As described above, when the conductive transparent members 58 and 54 are respectively arranged to face those components which are arranged between the upstream side of the charger 2 and the downstream side of the transfer charger 20 with respect to the rotational direction of the photoconductive drum 1, i.e., the optical system 13 and the toner deposition amount measuring device 8, toner can be effectively prevented from being attached to the optical system 13 and the measuring device 8. Specifically, in measuring an amount of deposited toner in the reversal development, for example, a tone pattern for detecting the amount of deposited toner is exposed with the potential VL by the optical system 13 on the surface of the photoconductive drum 1 negatively charged at the potential V0, and the tone pattern is developed by toner negatively charged at the developing bias voltage VD. A region on the drum 1 to which the developed tone pattern is attached is exposed again by the measuring device 8 to measure the amount of deposited toner, and the region has a potential VLS close to ground rather than the potential VL of a region exposed by the optical system 13. For this reason, the negatively charged toner on the drum 1 tends to move to the region having the potential VLS, the toner particles are easily scattered from the drum during the movement of the toner. Therefore, when the conductive transparent member 54 is provided to the measurement device 8, the scattered toner particles can be effectively prevented from being attached to the measuring device.

On the other hand, the toner which is not cleaned and is left on the photoconductive drum 1 is negatively charged by the charger 2 to have a negative polarity. For this reason, when the negatively charged residual toner reaches to a position opposite to the optical system 13, if the optical system is set in an electric floating state or the optical system has a potential higher than that of the surface of the drum, the residual toner particles are scattered from the drum to be attached to the optical system. Therefore, as described above, when the conductive transparent member 58 is arranged between the photoconductive drum 1 and the optical system 13, this arrangement is very effective to prevent the toner from being attached to the optical system.

An optical device such as toner deposition amount measuring device 8 may be arranged between the upstream side of the transfer charger 20 and the downstream side of the charger 2, and a conductive transparent member may be arranged between the optical device and the photoconductive drum 1. However, in this case, it is difficult to effectively prevent the toner from being attached to the optical device. Specifically, when a toner image on the photoconductive drum 1 is to be transferred to a transfer sheet at a transfer position, voltages having a polarity opposite to the potentials V0, VL, and VD are applied to the transfer paper and the toner. For this reason, the toner left on the drum 1 includes positively charged toner particles and negatively charged toner particles, the polarity of the toner is unstable. Therefore, even when the predetermined bias voltage is applied to the conductive transparent member, the residual toner particles scattered from the photoconductive drum 1 may be attached to the conductive transparent member.

Accordingly, it is found that, when the conductive transparent members are arranged to face those components which are arranged between the upstream side of the charger 2 and the downstream side of the transfer charger 20 with respect to the rotational direction of the photoconductive drum 1, and a predetermined bias voltage is applied to the conductive transparent members, the scattered toner can be effectively prevented from being attached to the conductive transparent members.

Figure 9:
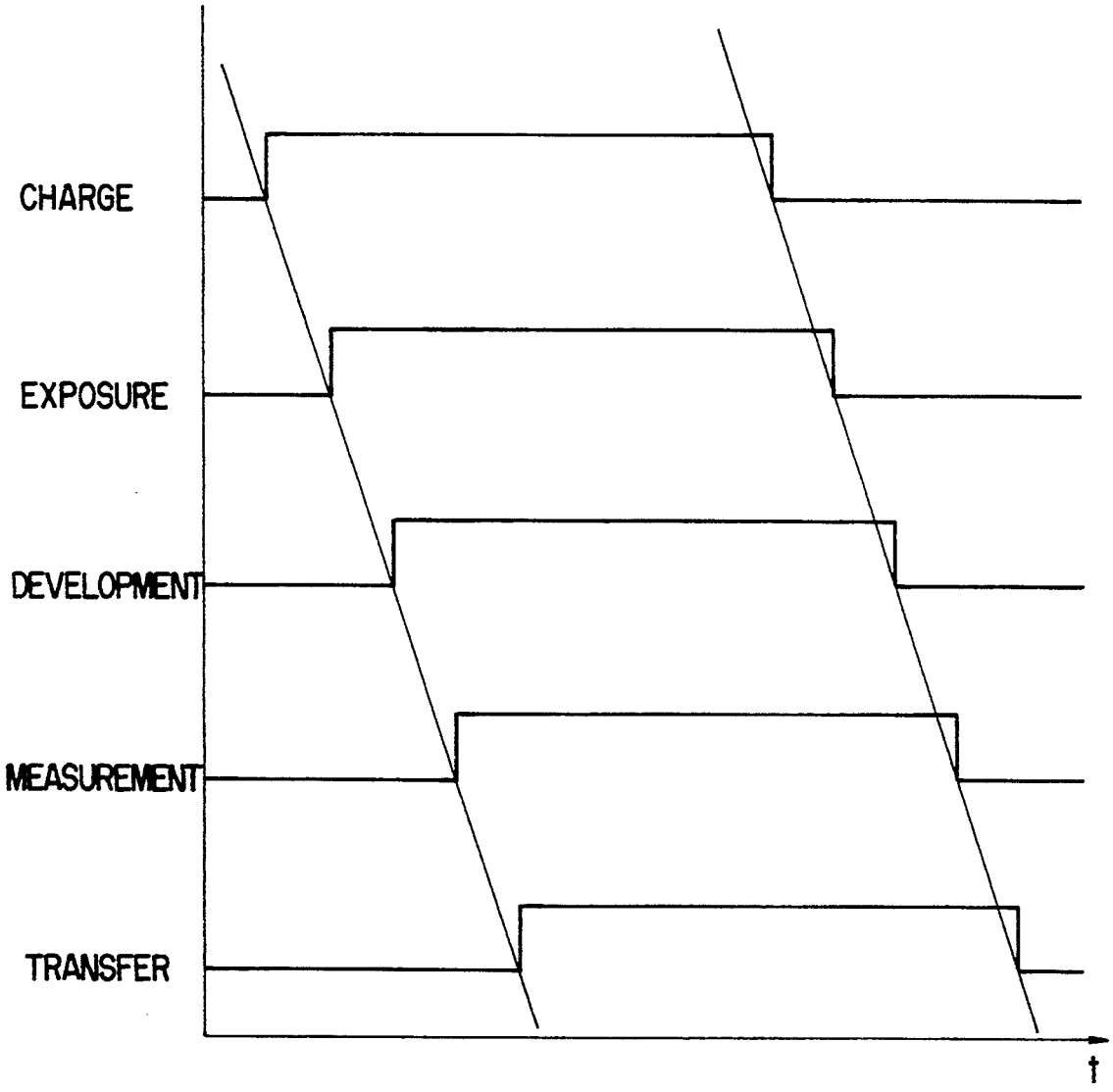

On the other hand, as described above, some toner particles, which are not cleaned, are left on the surface of the photoconductive drum 1. For this reason, when biases are applied to the conductive transparent members 54 and 58 simultaneously with application of the voltage from the charger 2, the residual toner particles on the drum may be attracted to the conductive transparent members. Therefore, as shown in FIG. 9, timings at which predetermined bias voltages are applied from the bias power supply 56 to the conductive transparent members 54 and 58 must be controlled in accordance with an image forming process. Specifically, when the charged region on the drum surface negatively charged by the charger 2 reaches the exposure position, application of the bias to the conductive transparent member 58 must be started. Similarly, when the charged region reaches the measurement position of the measuring device 8, application of the bias to the conductive transparent member 54 must be started. In addition, when the terminal end of the charged region on the drum 1 reaches the exposure position, the application of the bias to the conductive transparent member 58 is stopped when the terminal end of the charged region reaches the measurement position, the application of the bias to the conductive transparent member 54 is stopped.

Figure 10:
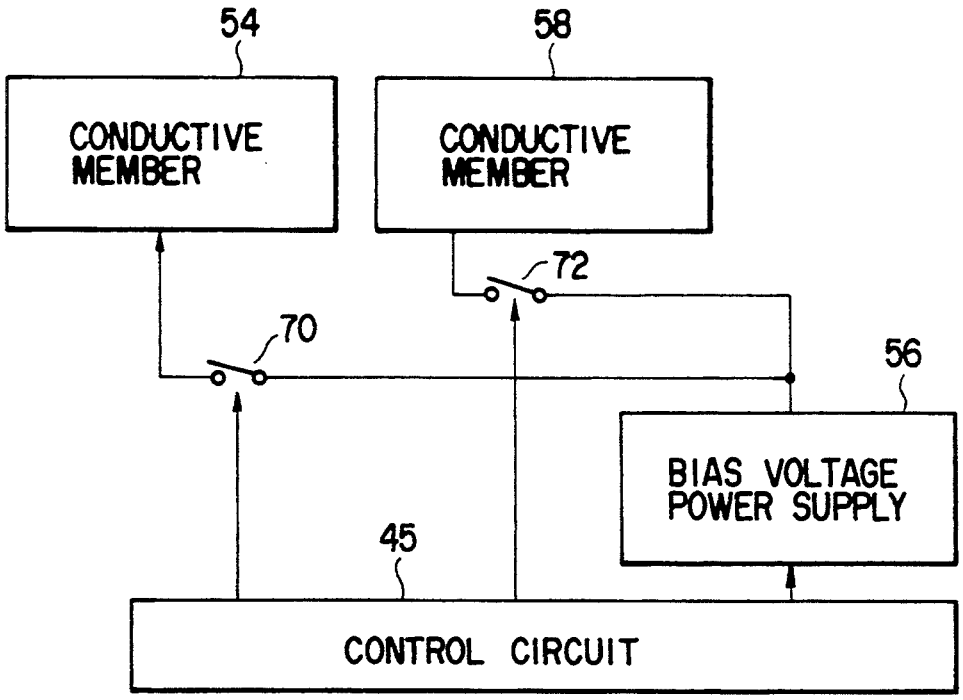

According to this embodiment, as shown in FIG. 10, the conductive transparent members 54 and 58 are connected to the bias power supply 56 through switches 70 and 72 serving as timing adjusting means, respectively. These switches 70 and 72 are connected to the control circuit 45, and are switched by the control circuit in accordance with the image forming processes, i.e., in accordance with the movement of the charged region on the photoconductive drum 1.

In the color laser printer arranged as described above, a predetermined voltage is applied to the conductive transparent member 54 arranged between the photoconductive drum 1 and the light source 81 and the photoelectric converter 82 of the measuring device 8 at a timing in accordance with the image forming processes, and a predetermined voltage is applied to the conductive transparent member 58 arranged to face the drum in the optical path of the laser optical system 13 at a timing in accordance with the image forming process, thereby preventing scattered toner particles from becoming attached to the conductive transparent members 54 and 58. More specifically, the application voltage VCG to the conductive transparent members 54 and 58 is set within the range of $V0 \geqq VCG \geqq VD$ in the reversal development and set within the range of $VD \geqq VCG \geqq 0$ V in the normal development. For this reason, all positively, negatively, and reversely charged toner particles can be reliably prevented from being attached to the conductive transparent members 54 and 58 in both the reversal and normal development modes.

In the toner deposition amount measuring device 8, since scattered toner particles can be prevented from being attached to the light source 81 and the photoelectric converter 82, high detecting precision can be maintained for a long time. In addition, in the laser optical system 13, scattered toner particles can be prevented from being attached to the optical members such as a glass, a lens, and a mirror, arranged in the optical path in the laser optical system 13, for guiding a laser beam to the photoconductive drum 1, and accurate image data can be guided to the photoconductive drum 1. Therefore, in the color laser printer of this embodiment, a high-quality image can be stably formed for a long time. Further, maintenance of the measuring device 8 and the laser optical system 13 can be easily performed or omitted, and the running cost of the color laser printer can be reduced.

Figure 11:
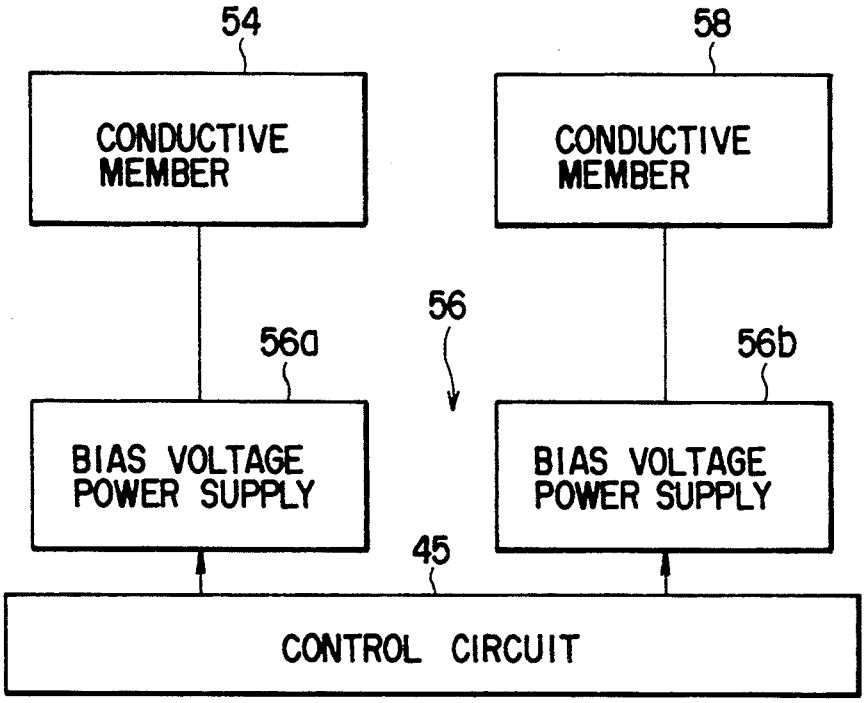
FIG. 11 is a schematic view showing a connection between power supplies and the conductive transparent members when two power supplies are used.

In the above embodiment, a bias is applied to the conductive transparent members 54 and 58 by using the single bias power supply 56. However, as shown in FIG. 11, bias power supplies **56*a* and 56*b*, respectively arranged for the conductive transparent members 54 and 58, may be used. In this case, the operation timings of the bias power supplies 56*a* and 56*b* are directly controlled by the control circuit 45, and bias voltages can be applied to the conductive transparent members 54 and 58** in synchronism with the image forming process timing.

In the above-mentioned embodiment, the independently arranged bias power supply 56 is provided to apply a predetermined voltage to the conductive transparent members 54 and 58. The voltage applying means may be arranged as follows.

As described above, in the reversal development, if the application voltage VCG to the conductive transparent members 54 and 58 is set within the range of $V0 \geqq VCG \geqq VD$, scattered toner particles can be prevented from becoming attached to the conductive transparent members 54 and 58.

Figure 12:
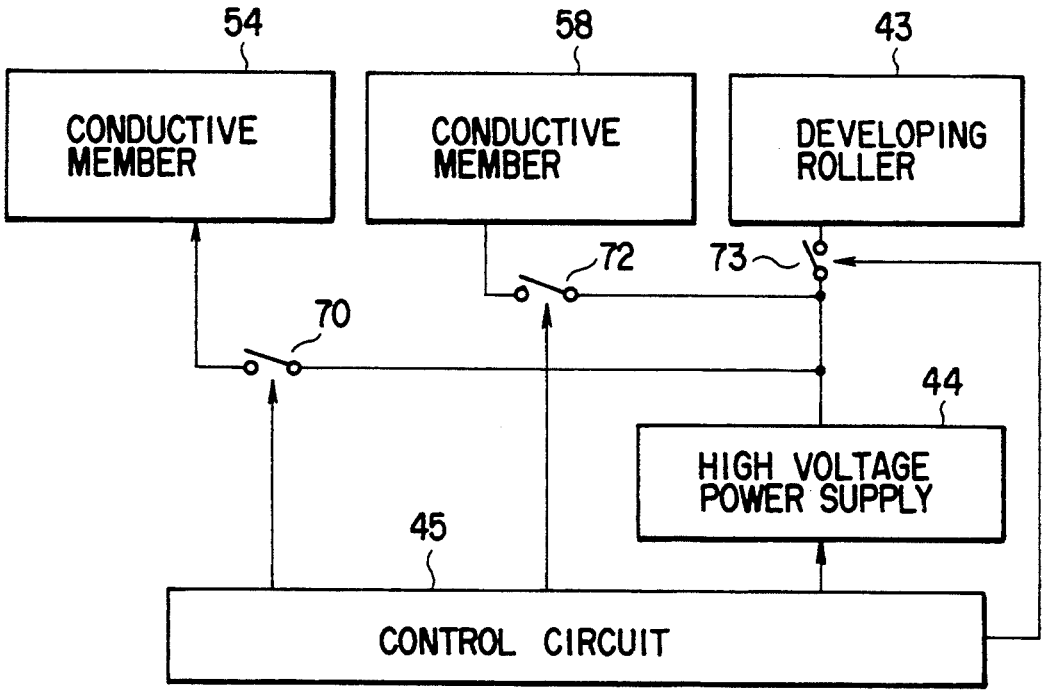
FIG. 12 is a view showing an arrangement in which a developing bias high-voltage power supply is connected to the conductive transparent members.

As shown in FIG. 12, the developing bias high-voltage power supply 44 for applying a bias voltage to the developing roller 43 is electrically connected to the conductive transparent members 54 and 58 through switches 70 and 72, and the developing bias voltage VD may be applied to these conductive transparent members. Note that since the bias voltage must be continuously applied to the conductive transparent member 54 after the application of the bias voltage to the developing roller 43 is stopped, a switch 73 which is turned on and off by the control circuit 45 is arranged between the developing roller and the high-voltage power supply 44.

Figure 13:
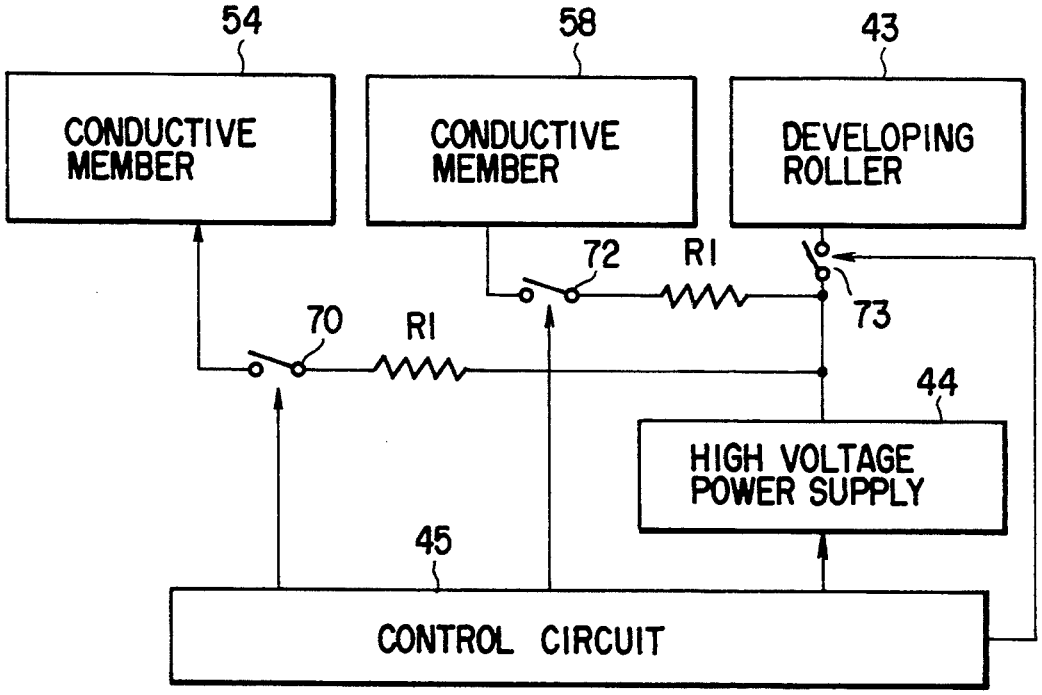
FIG. 13 is a view showing an arrangement in which the development bias high-voltage power supply is connected to the conductive transparent members through resistors.

In this case, as shown in FIG. 13, if resistors R1 are interposed between the high-voltage power supply 44 and the conductive transparent member 54 and between the high-voltage power supply 44 and the conductive transparent member 58, respectively, current leakage or the like caused by connecting the high-voltage power supply 44 to the conductive transparent members can be prevented.

Figure 14:
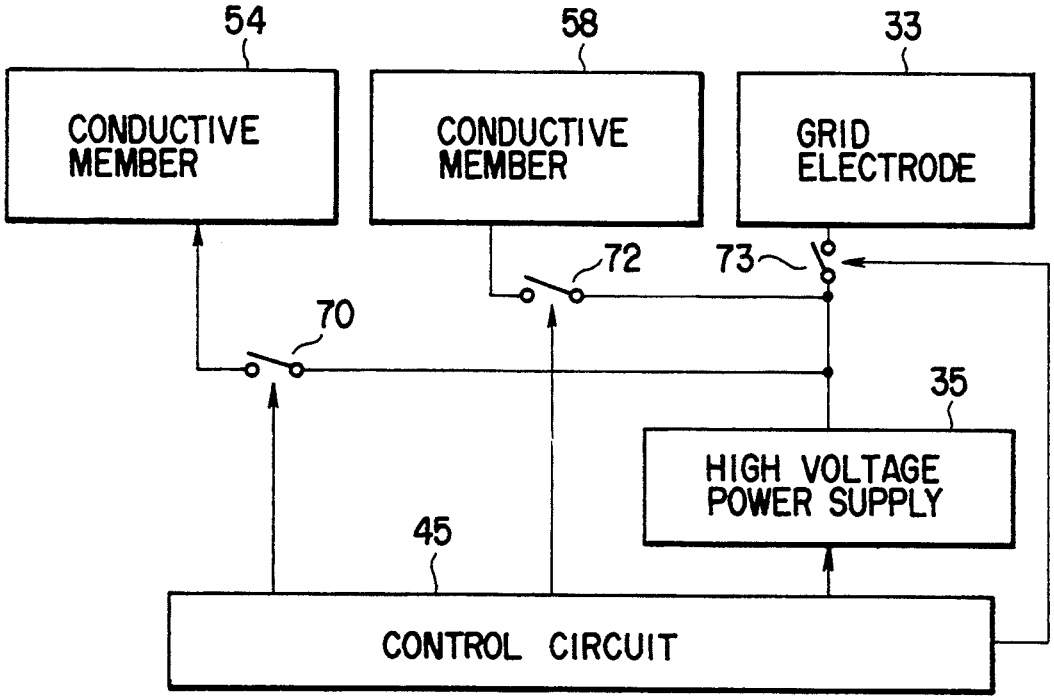
FIG. 14 is a view showing an arrangement in which a grid bias high-voltage power supply is connected to the conductive transparent members.

As shown in FIG. 14, the high-voltage power supply 35 for applying a grid bias voltage to the grid electrode 33 may be electrically connected to the conductive transparent members 54 and 58 through switches 70 and 72. In this case, the high-voltage power supply 35 may apply a voltage to the conductive transparent members 54 and 58.

Figure 15:
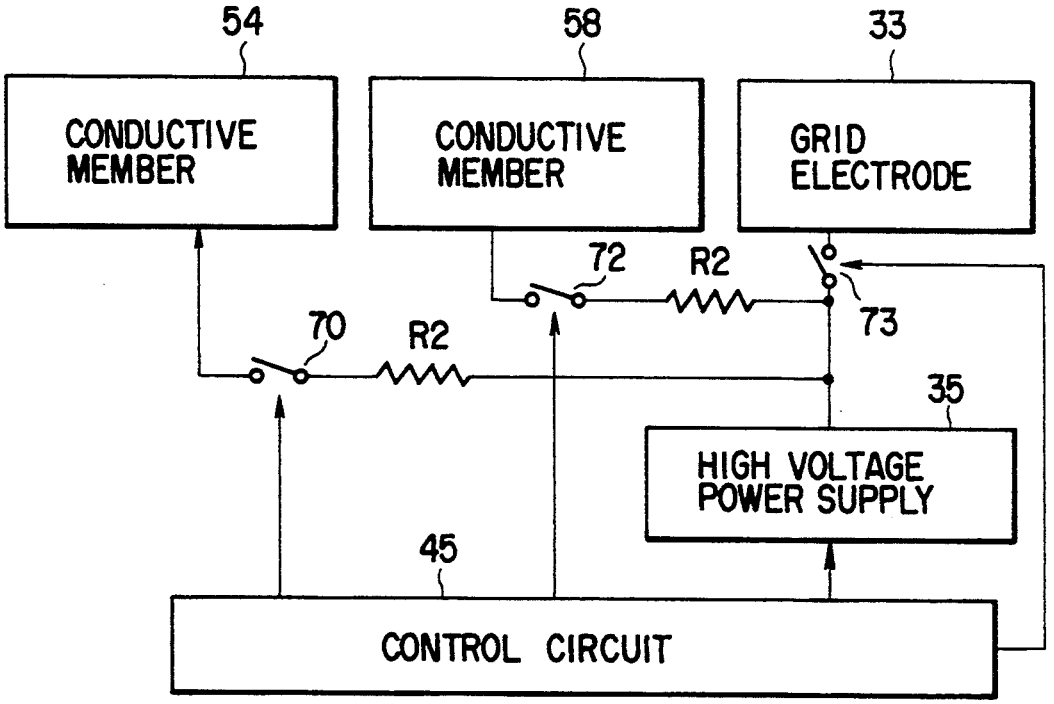
FIG. 15 is a view showing an arrangement in which the grid bias high-voltage power supply is connected to the conductive transparent members through resistors.

In this arrangement, as shown in FIG. 15, if resistors R2 are interposed between the high-voltage power supply 35 and the conductive transparent member 54 and between the high-voltage power supply 35 and the conductive transparent member 58, respectively, current leakage or the like caused by connecting the high-voltage power supply 35 to the conductive transparent members can be prevented.

Figure 16:
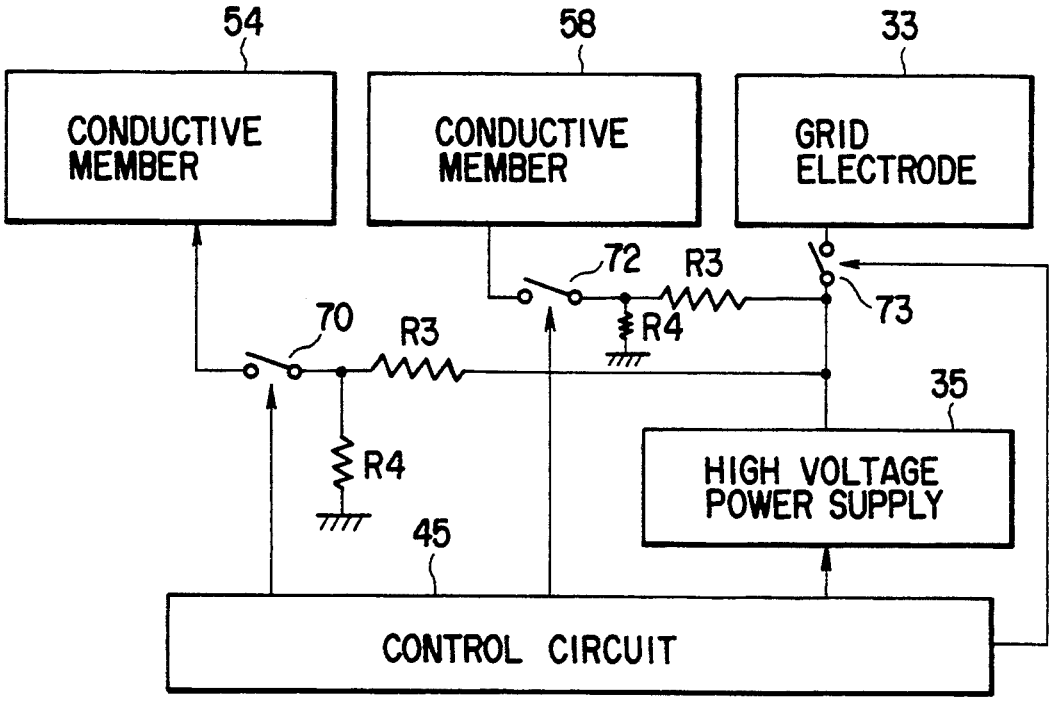
FIG. 16 is a view showing an arrangement in which the grid bias high-voltage power supply is connected to the conductive transparent members through a plurality of resistors.

As shown in FIG. 16, the voltage from the high-voltage power supply 35 may be divided by resistors R3 and R4 having high resistances such that a voltage applied to the conductive transparent members is set within the range of $V0 \geqq VCG \geqq VD$, and the divided voltages may be applied to the conductive transparent members 54 and 58, respectively.

On the other hand, as described above, in normal development, when the application voltage VCG to the conductive transparent members 54 and 58 is set within the range of $VD \geqq VCG \geqq 0$ V, scattered toner particles can be prevented from being attached to the conductive transparent members.

As shown in FIGS. 12 and 13, as in the reversal development, the conductive transparent members 54 and 58 may be connected to the developing bias high-voltage power supply 44 directly or through resistors, and the high-voltage power supply 44 may apply the developing bias voltage to the conductive transparent members 54 and 58.

Figure 17:
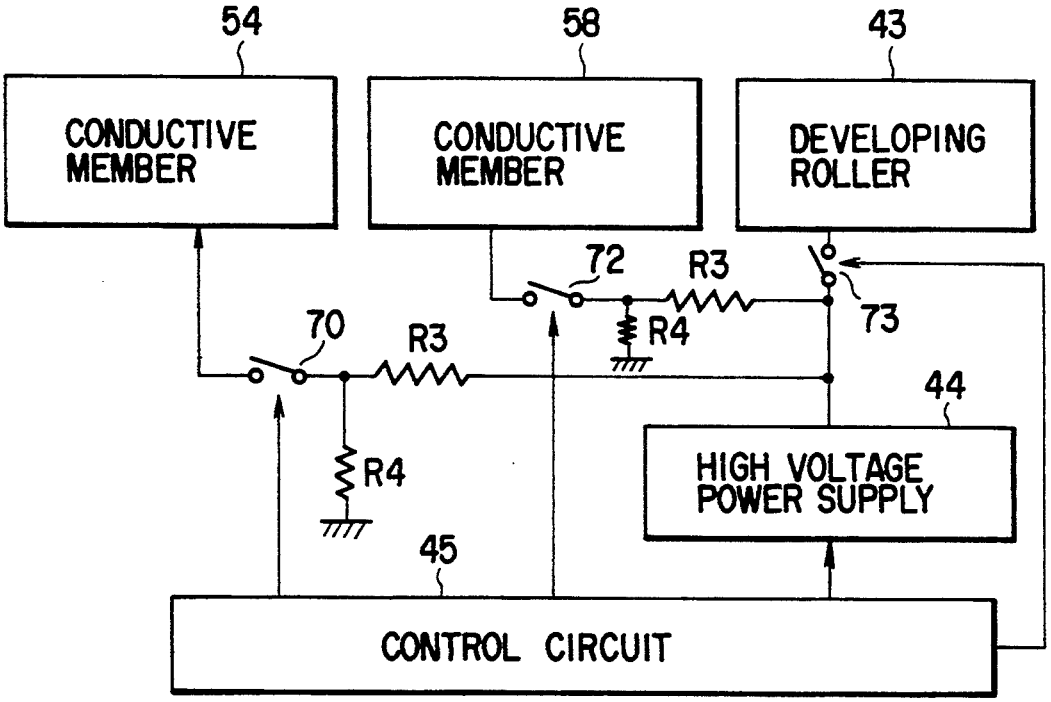
FIG. 17 is a view showing an arrangement in which the development bias high-voltage power supply is connected to the conductive transparent members through a plurality of resistors.

In this case, as shown in FIG. 17, the voltage from the high-voltage power supply 44 may be divided by resistors R6 and R7 having high resistances such that a voltage applied to the conductive transparent members 54 and 58 is set within the range of $VD \geqq VCG \geqq 0$ V, and the divided voltages may be applied to the conductive transparent members 54 and 58, respectively.

Figure 18:
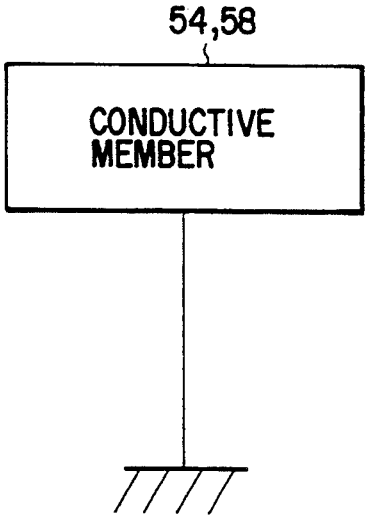
FIG. 18 is a view showing an arrangement in which the conductive transparent members are grounded.

In the normal development, even if a voltage applied to the conductive transparent members 54 and 58 is set to be 0 V, it is within a predetermined range. As shown in FIG. 18, therefore, the conductive transparent members 54 and 58 may be electrically connected to ground.

Figure 19:
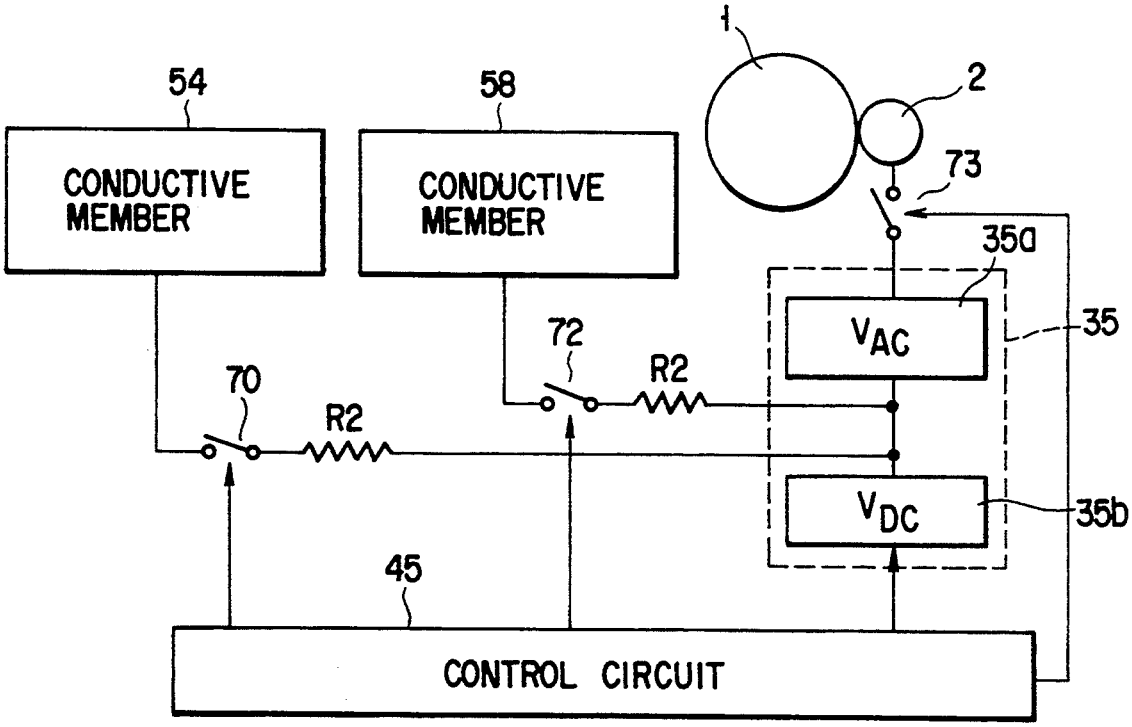
FIG. 19 is a view showing an arrangement in which a charge roller and a high-voltage power supply obtained by combining an AC power source and a DC power source.
Figure 20:
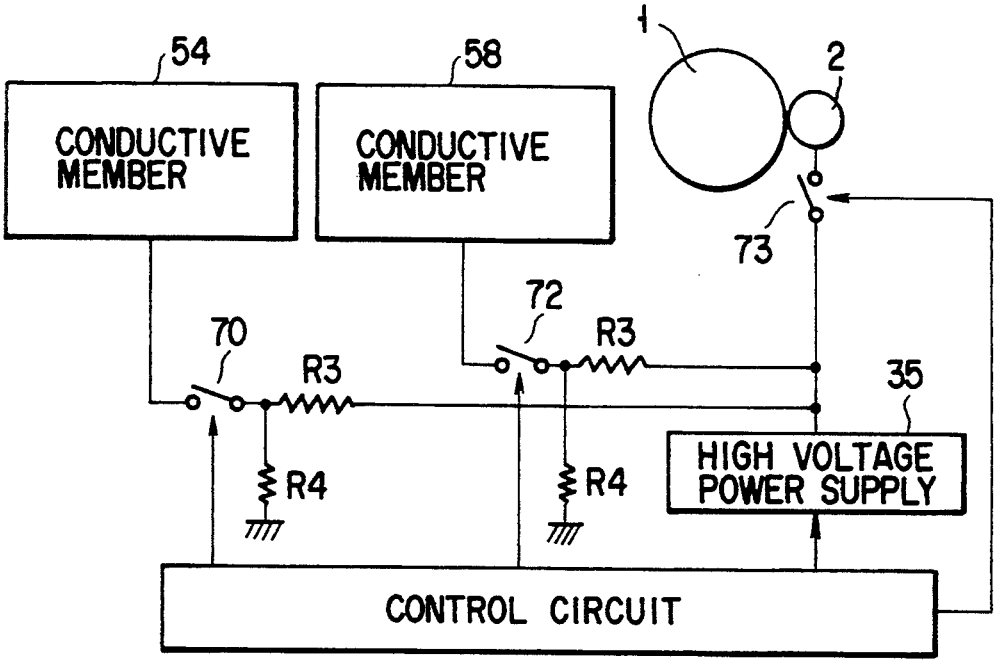
FIG. 20 is a view showing an arrangement in which a charge roller and a DC power source are used.

In the above-mentioned embodiment, although a noncontact type charger having a grid electrode is used as the charger 2, a contact type charger having a charging roller, a charging brush, or a charging blade contacting the photoconductive drum 1 may be used as the charger 2. FIGS. 19 and 20 show embodiments in each of which a charging roller is used as a charger 2, and conductive transparent members 54 and 58 are connected to a high-voltage power supply 35 for applying a bias voltage to the charging roller. In the embodiment shown in FIG. 19, a high-voltage power supply obtained by combining an AC power supply 35*a* and a DC power supply 35*b* is used as the high-voltage power supply 35. In the embodiment shown in FIG. 20, only a DC power supply is used as the high-voltage power supply 35.

Figure 21:
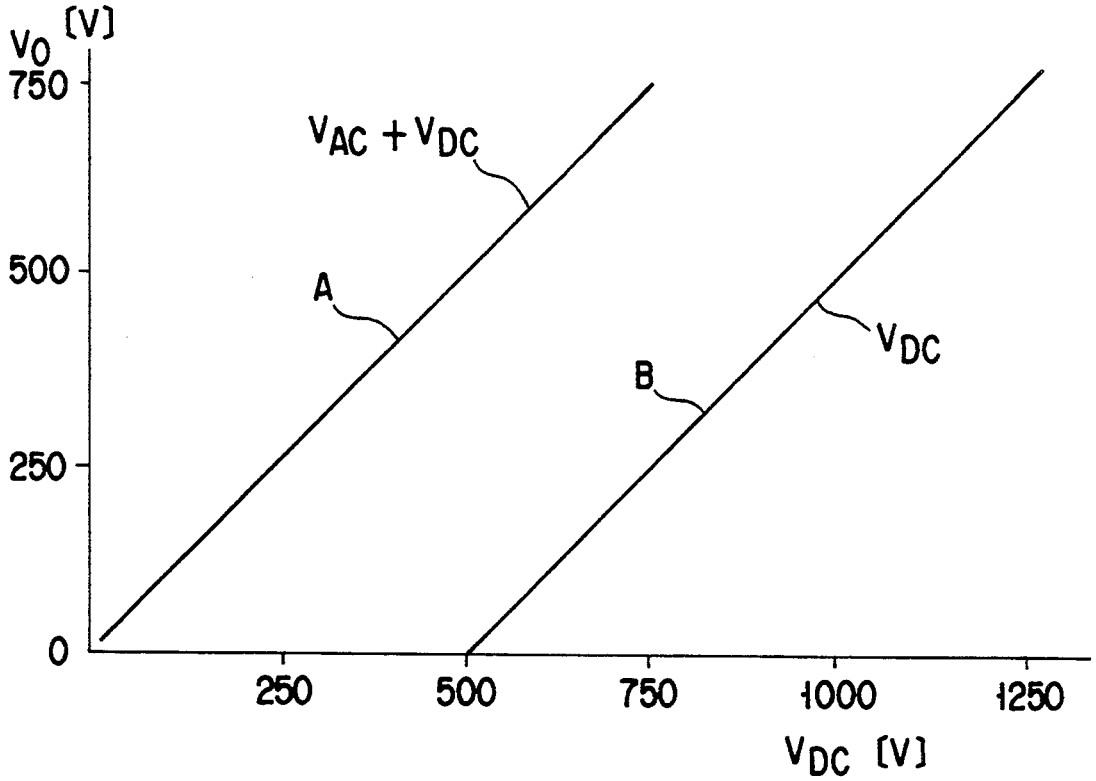
FIG. 21 is a graph showing the relationship between a power supply voltage and an applied voltage.

The high-voltage power supply obtained by combining the AC power supply 35*a* and the DC power supply 35*b* and the high-voltage power supply formed by only the DC power supply have different charge characteristics as shown in FIG. 21. Specifically, when the high-voltage power supply 35 obtained by combining the AC power supply 35*a* and the DC power supply 35*b* is used, if an AC component (amplitude) is increased to some extent, as indicated by a characteristic curve A in FIG. 21, a photoconductive drum 1 is charged at a charge potential V0 substantially equal to a DC component. Therefore, as shown in FIG. 19, when the high-voltage power supply 35 is connected to the conductive transparent members 54 and 58 such that a voltage is applied from the DC power supply 35*b* of the high-voltage power supply 35 to the conductive transparent members 54 and 58, a bias voltage equal to the charge potential can be applied to the conductive transparent members 54 and 58.

When the high-voltage power supply 35 formed by only the DC power supply is used, as indicated by a characteristic curve B in FIG. 21, an application voltage VDC is different from the charge voltage V0. A difference between the application voltage VDC and the charge potential V0 is almost constant with respect to the application voltage. Therefore, when the high-voltage power supply 35 is directly connected to the conductive transparent members 54 and 58, a voltage higher than the charge voltage V0 is applied to the transparent members, and toner is disadvantageously attached to the transparent members. For this reason, as shown in FIG. 20, resistors R3 and R4 having high resistances are arranged between the high-voltage power supply 35 and the conductive transparent member 54 and between the power supply 35 and the conductive transparent member 58, respectively, and the voltage VDC applied from the high-voltage power supply is decreased to a voltage with in the range between the charge potential V0 and a developing bias voltage VL.

According to the arrangements shown in FIGS. 12 to 17 and FIGS. 19 and 20, a predetermined voltage can be applied to the conductive transparent members 54 and 58 by using the developing bias high-voltage power supply 44 or the high-voltage power supply 35 for applying the charging voltage. Therefore, without providing an independent power supply for applying a predetermined voltage to the conductive transparent members, the same effects as in the above-mentioned embodiment can be obtained. Accordingly, the arrangement can be simplified, and the manufacturing cost of the printer can be reduced.

When a predetermined voltage is applied to the conductive transparent members 54 and 58 by using the high-voltage power supply 44 or 35, in addition to the advantages of the above-mentioned embodiment, the following advantages can be obtained.

Specifically, developing characteristics, e.g., the density (amount of deposited toner) of a toner image formed on the photoconductive drum 1, are generally changed in accordance with environmental changes or a secular changes. For this reason, an amount of toner deposited to the surface of the photoconductive drum 1 is detected by the toner deposition amount measuring device 8, and the control circuit 45 changes at least one of a grid bias voltage, a developing bias voltage, the exposure amount of the laser optical system 13, and the emission time of the toner density area tone of the developing agent, in accordance with the detected value so as to cope with the changes in developing characteristics. More specifically, in this embodiment, the following control system is used. That is, the changes in the developing characteristics are detected by the measuring device 8, and the bias conditions of the grid bias voltage and the developing bias voltage are changed based on the detected value.

More specifically, the laser optical system 13 is driven on the basis of a test pattern output from the pattern generating circuit 38 to the laser driving circuit 37, and a latent image pattern is formed on the surface of the photoconductive drum 1 by the laser beam 14 emitted from the laser optical system 13. This latent image pattern is developed by the developing unit 4 to form a test pattern which is visible as a toner image. An amount of deposited toner of the resultant test pattern is detected by the measuring device 8, and the control circuit 45 controls output voltages from the high-voltage power supplies 44 and 35 on the basis of the detected value. A developing bias voltage applied to the developing unit 4 and a grid bias voltage applied to the grid electrode 33 for controlling the charging characteristics of the charger 2 are changed to set optimal image conditions.

In this case, the conductive transparent member 54 arranged on the surface of the measuring device 8 opposite to the photoconductive drum 1 and the conductive transparent member 58 arranged in the optical path of the laser beam 14 output from the laser optical system 13 to the photoconductive drum 1 are connected to the developing bias high-voltage power supply 44 through the resistors R1 or to the charging high-voltage power supply 35 through the resistors R2.

Therefore, when the developing bias voltage or the grid bias voltage (charging voltage) is changed by the above control operation, the bias values of the conductive transparent members 54 and 58 are also changed in accordance with the change in the voltage values.

Figure 22:
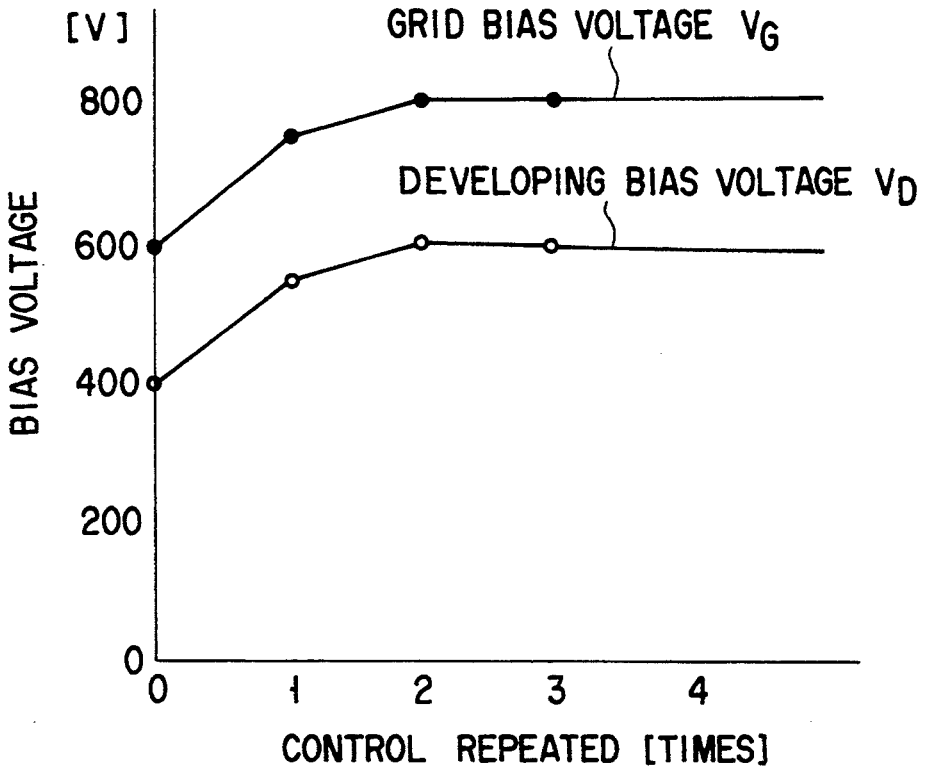
FIG. 22 is a graph showing a method of controlling a bias voltage in a low-temperature and low-humidity atmosphere.
Figure 23:
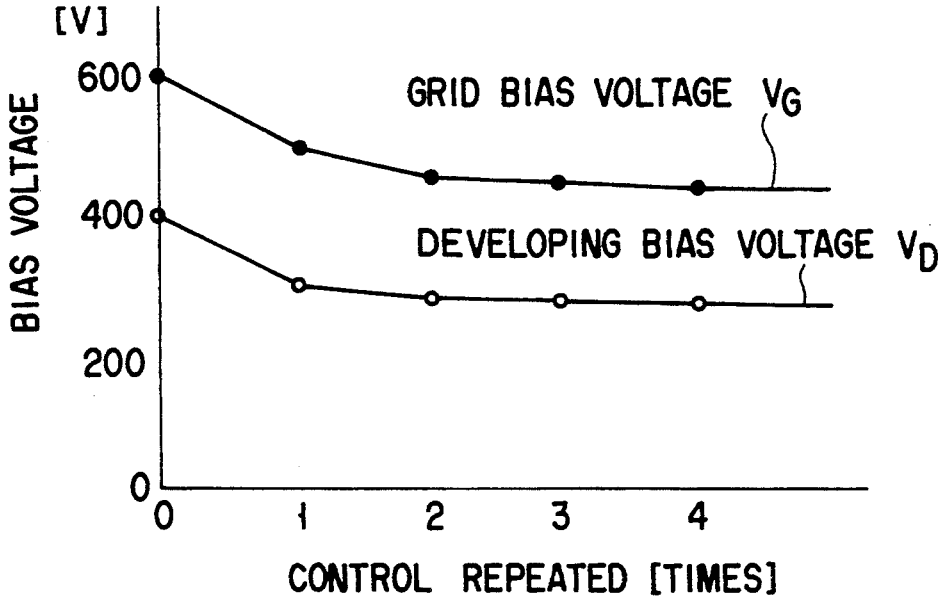
FIG. 23 is a graph showing a method of controlling a bias voltage in a high-temperature and high-humidity atmosphere.

FIGS. 22 and 23 show changes in bias voltage by control operations in different atmospheres. FIG. 22 shows a control operation in a low-temperature, low-humidity atmosphere (10° C., 20% RH), and FIG. 23 shows a control operation in a high-temperature, high-humidity atmosphere (35° C., 90% RH).

In the low-temperature, low-humidity atmosphere, both the grid bias voltage (charging voltage) and the developing bias voltage are increased. In the high-temperature, high-humidity atmosphere, both the grid bias voltage (charging voltage) and the developing bias voltage are decreased. Note that, in these control operations, a difference between the grid bias voltage and the developing bias voltage also varies.

In reversal development, toner is not easily attached to a member applied with a voltage ranging from the grid bias voltage to the developing bias voltage. In two-component development, carriers are not easily attached to the member.

If application voltage to the conductive transparent members is fixed, and the grid bias voltage and the developing bias voltage vary, the application voltage may be out of the range in which toner particles or carriers are not easily attached to the conductive transparent members. When the application voltage is lower than the developing bias voltage, the toner particles are easily attached to the conductive transparent members. In addition, the application voltage is higher than the grid bias voltage (charge voltage), reversely charged toner particles or carriers are easily attached to the conductive transparent members.

As described above, when the conductive transparent members are electrically connected to the charging power supply or the developing bias power supply, the application voltage to the conductive transparent members is automatically changed in accordance with change in the developing bias voltage or grid bias voltage (charging voltage). For this reason, deposition of toner to the conductive transparent members can be prevented, or deposition of carriers to the conductive transparent members can be prevented in the two-component development. Therefore, a special-purpose application voltage control device is not required, the arrangement can be simplified, and the production cost can be reduced.

Figure 24:
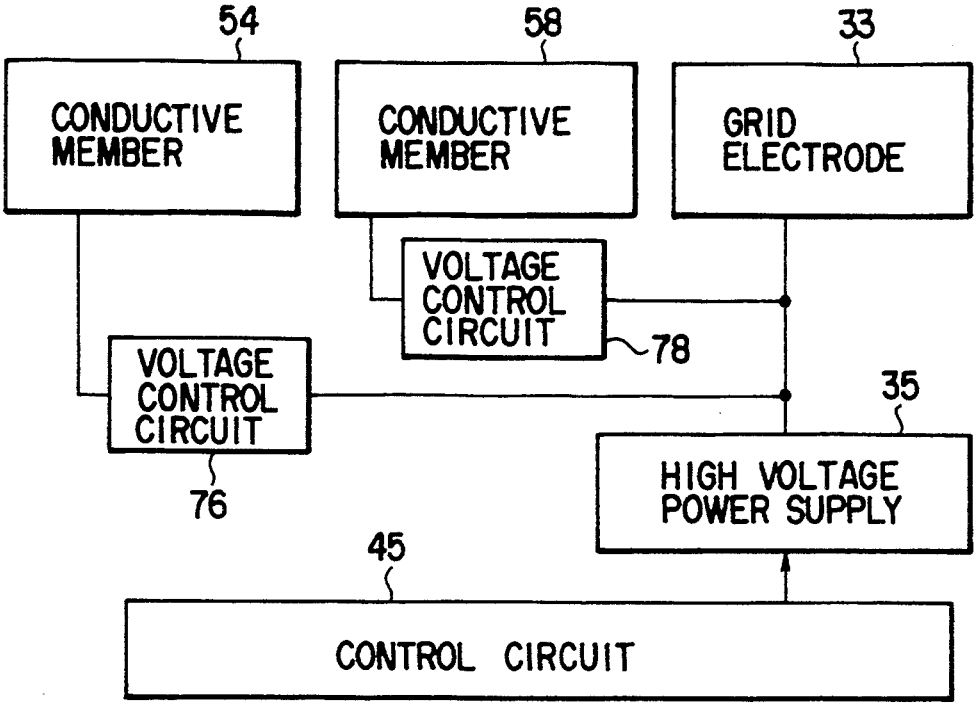
FIG. 24 is a view showing an arrangement in which the conductive transparent members are connected to the high-voltage power supply through voltage control units.
Figure 25:
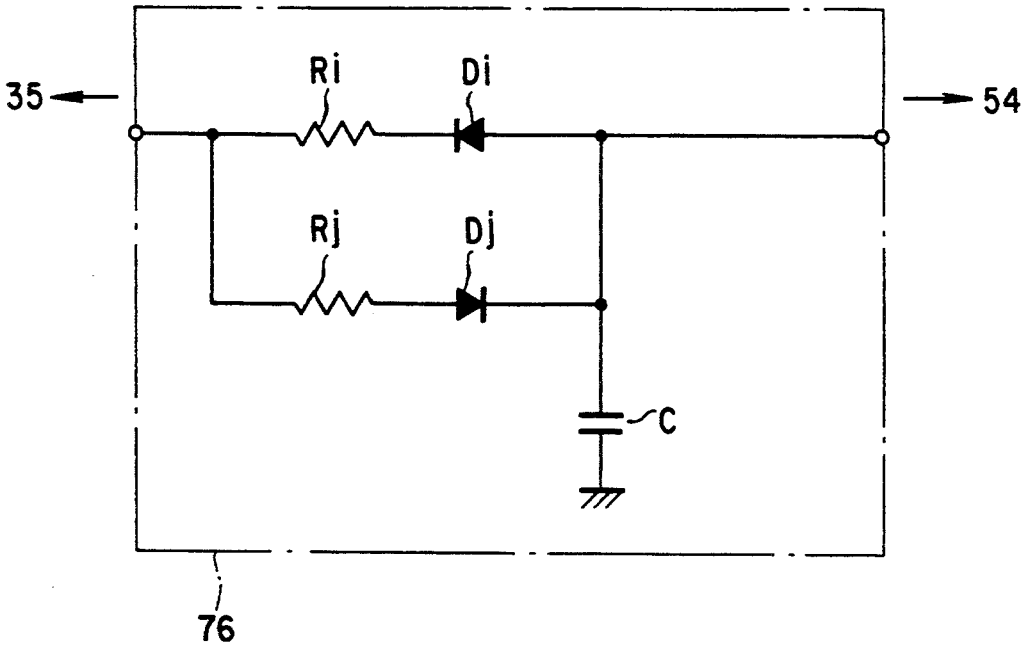
FIG. 25 is a schematic view showing an arrangement of the voltage control unit.

In the above embodiments, although the switches 70, 72, and 73 are used as adjusting means for adjusting the timings of the start and stop of voltage application to the conductive transparent members 54 and 58 to timings of image forming processes, a voltage control unit having a delay circuit may be used as the adjusting means. For example, in the arrangement shown in FIGS. 24 and 25, a conductive transparent member 54 is connected to a charging high-voltage power supply 35 through a first voltage control unit 76, and a conductive transparent member 58 is connected to the charging high-voltage power supply 35 through the second voltage control unit 78. For example, the control unit 76 has resistors Ri and Rj and diodes Di and Dj which are connected in parallel to one another. The diodes Di and Dj are connected to ground through a capacitor C.

Figure 26:
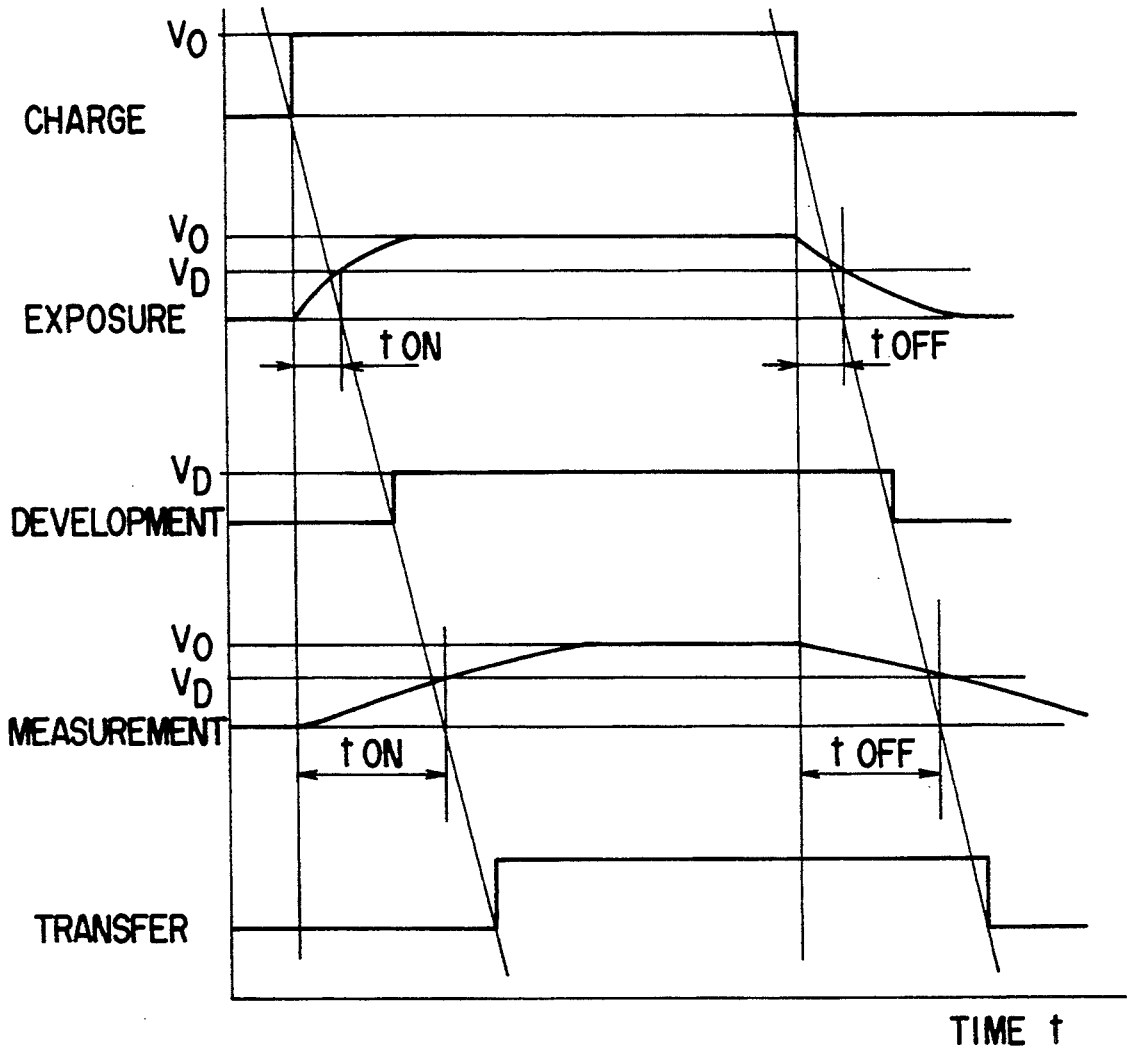
FIG. 26 is a timing chart showing timings at which voltages are applied to the charger, the conductive transparent member of the exposure optical system, the developing unit, the conductive transparent member of the measuring device, and the transfer charger when the voltage control units are used.

As shown in FIG. 26, the first voltage control unit 76 has a delay circuit having a predetermined time constant. The control unit 76 controls a voltage V0 applied from the high-voltage power supply 35 such that a voltage VCG applied to the conductive transparent member 54 increases to a voltage VD equal to the developing bias voltage as a predetermined time tON elapses after the high-voltage power supply 35 has been turned on. Further, the control unit 76 controls the voltage applied from the high-voltage power supply 35 such that the voltage VCG applied to the conductive transparent member 54 decreases to the voltage VD equal to the developing bias voltage as a predetermined time tOFF elapses after the high-voltage power supply 35 has been turned off.

The delay circuit of the first voltage control unit 76 has, e.g., time-voltage characteristics in rise time expressed by equation (1) and time-voltage characteristics in fall time expressed by equation (2).

$$V_{CG} = V_O(1 - e^{\frac{-tON}{TON}}), \quad (1)$$

$$V_{CG} = V_O e^{\frac{-tOFF}{TOFF}} \quad (2)$$

where VCG is a voltage applied to the conductive transparent member 54, TON is a time constant in rise time, tON is a time period from when the high-voltage power supply 35 is turned on to when the applied voltage VCG reaches the voltage VD, TOFF is a time constant in fall time, and tOFF is a time period from when the high-voltage power supply 35 is turned off to when the applied voltage VCG decreases to the voltage VD. The time constants TON and TOFF have the following relationship: TON =CRj, and TOFF =CRi.

The time periods tON and tOFF are expressed by the following equations (3) and (4) when a distance along the outer surface of the photoconductive drum 1 between a charging position and a toner deposition amount measurement position is represented by d1, and the circumferential speed of the photoconductive drum 1 is represented by v.

$$tON = d1/v \quad (3),$$

$$tOFF = d1/v \quad (4)$$

According to equations (1) and (3) and equations (2) and (4), the time constants TON and TOFF are given by the following equations (5) and (6):

$$T_{ON} = \frac{d_1}{V\log e^{(1-\frac{VD}{VO})}} \quad (5)$$

$$T_{OFF} = -\frac{d_1}{V\log e^{(\frac{VD}{VO})}} \quad (6)$$

In this case, since tON=tOFF, when the charging voltage and the developing bias voltage satisfy a condition of V0/VD=½, the time constants TON and TOFF have a equal value as expressed by the following equation (7). When the time constants TON and TOFF have the equal value, the circuit arrangement can be simplified.

$$T_{ON} = T_{OFF} = \frac{\frac{d_1}{V}}{\log e^{(\frac{1}{2})}} \approx 1.44\frac{d_1}{V} \quad (7)$$

Similarly, the second voltage control unit 78 has a delay circuit having a predetermined time constant, controls the voltage V0 applied from the high-voltage power supply 35 such that a voltage VCG applied to the conductive transparent member 58 increases to a voltage VD equal to the developing bias voltage a predetermined time tON after the high-voltage power supply 35 is turned on, and controls the voltage V0 applied from the high-voltage power supply 35 such that the voltage VCG applied to the conductive transparent member 58 decreases to the voltage VD a predetermined time tOFF after the high-voltage power supply 35 is turned off. The delay circuit of the second voltage control unit 78 has, e.g., time-voltage characteristics in rise and fall time expressed by equations (1) and (2), and time constants TON and TOFF are determined by equations (5) and (6).

Even when the adjusting means arranged as described above is used, as in the above embodiments, a bias voltage can be applied to the conductive transparent members 54 and 58 in synchronism with image forming process timings. Therefore, toner particles which are positively, negatively, and reversely charged can be reliably prevented from being attached to the conductive transparent members 54 and 58 in each of the reversal 10 and normal development modes.

The present invention is not limited to the above-mentioned embodiments, and various changes and modifications may be effected without departing from the spirit and scope of the invention.

For example, a conductive transparent member need not be formed as an independent plate-like member. A conductive transparent members may formed on those components of the laser optical system 13 or the measuring device 8, which are adjacent to the photoconductive drum 1, e.g., a glass, a lens, and a mirror, and a voltage may be applied to the conductive transparent members.

Figure 27:
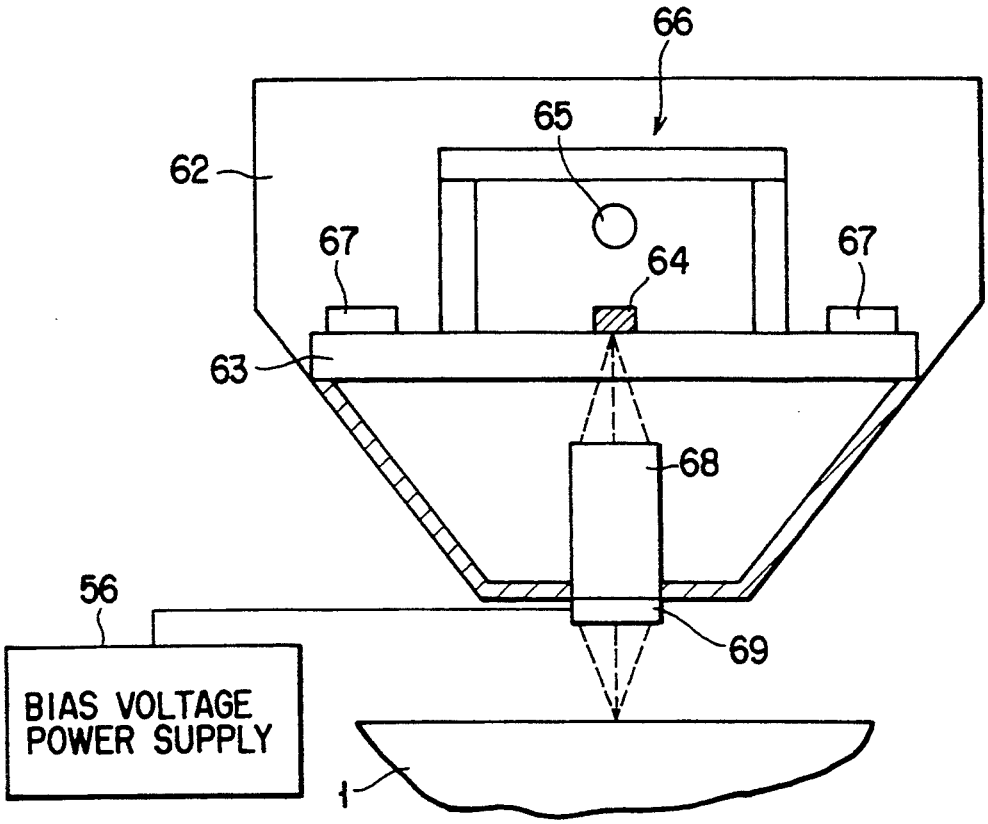
FIG. 27 is a sectional view showing a solid-state head.

Optical means for radiating light beam on the photoconductive drum 1 is not limited to the toner deposition amount measuring device 8 and to the laser optical system 13. For example, as optical means, a solid-state head shown in FIG. 27 may be used.

This solid-state head is used in place of the laser optical system 13, and exposes the surface of the photoconductive drum 1 to form a latent image thereon. In this embodiment, a phosphor head, one of the solid-state heads, using phosphor as an light-emitting portion will be described. The phosphor head has a support member 62 formed of an insulating material, and a glass substrate 63 is provided on the support member. On the glass substrate 63 are arranged a light-emitting portion 66 constituted by a phosphor dot (anode) 64 and a cathode 65 opposite thereto, and a plurality of driving ICs 67 for driving the phosphor head. A rod lens array 68 for focusing a beam emitted from the light-emitting portion 66 and guiding the beam to the surface of the photoconductive drum 1 is supported by the support member 62. A conductive transparent member 69 is arranged on the emission surface of the rod lens array 68 and opposite to the surface of the photoconductive drum 1. A bias power supply 56 for applying a voltage to the conductive transparent member 69 is connected to the conductive transparent member 69.

The phosphor head arranged as described above causes the driving ICs 67 to output a signal corresponding to image data to the cathode 65, and the phosphor coated on the phosphor dot 64 is excited by hot electrons radiated from the cathode, thereby emitting a beam. The emitted beam passes through the glass substrate 63, is focused through the rod lens array 68 and is incident on the photoconductive drum 1.

When the above solid-state head is used, the conductive transparent member 69 arranged on the exit surface of the rod lens array 68 is applied with a voltage VD falling within a range of $V0 \geqq VD \geqq VL$ in reversal development and applied with the voltage VD falling within a range of $V0 \geqq VD \geqq VL$ in normal development. In this manner, scattered toner particles can be prevented from being attached to the conductive transparent member 69 and the rod lens array 68.

Additional advantages and modifications will readily occur to those skilled in the art. Therefore, the invention in its broader aspects is not limited to the specific details, and representative devices shown and described herein. Accordingly, various modifications may be made without departing from the spirit or scope of the general inventive concept as defined by the appended claims and their equivalents.

What is claimed is:

1. An image forming apparatus for forming an image on an image carrier comprising:

means for applying a voltage to said image carrier so as to form an image on said image carrier, the applying means including a charger which has a grid electrode arranged to face the image carrier, and a power supply for applying a grid bias voltage to the grid electrode;

optical means for radiating a light beam on said image carrier;

developing means for supplying a developing agent to the image carrier at a predetermined developing bias voltage;

voltage-dividing means for dividing the grid bias voltage applied from the power supply into a voltage ranging from the grid bias voltage to the developing bias voltage; and conductive transparent means arranged to face said image carrier, for transmitting the light beam from said optical means therethrough, said conductive transparent means being electrically connected to said applying means.

2. An apparatus according to claim 1, which further comprises developing means for supplying a developing agent to said image carrier, and wherein said applying means includes power supply means for applying a developing bias voltage to said developing means.

3. An image forming apparatus for forming an image on an image carrier comprising:

developing means for supplying a developing agent to an image carrier;

power supply means for applying a predetermined developing bias voltage to said developing means;

optical means for radiating a light beam on said image carrier;

conductive transparent means arranged to face said image carrier, for transmitting the light beam from said optical means therethrough, said conductive transparent means being electrically connected to said power supply means; and voltage-dividing means for dividing the developing bias voltage applied from the power supply means into a voltage between ground and the developing bias voltage.

4. An image forming apparatus for forming an image on an image carrier comprising:

charging means having a charging member contacting said image carrier, for applying a predetermined charging voltage to said image carrier;

optical means for radiating a light beam on said image carrier; and conductive transparent means arranged to face said image carrier, for transmitting the light beam from said optical means therethrough, said conductive transparent means being electrically connected to said charging means.

5. An apparatus according to claim 4, wherein said charging means includes power supply means for applying an AC voltage and a DC voltage to said charging member, and which further comprises means arranged between said power supply means and said conductive transparent means, for guiding said DC voltage to said conductive transparent means.

6. An apparatus according to claim 4, wherein said charging means includes power supply means for applying a DC voltage to said charging member, and which further comprises means arranged between said power supply means and said conductive transparent means, for decreasing said DC voltage to a predetermined voltage.

7. An image forming apparatus for forming an image on an image carrier comprising:

means for charging said image carrier to a predetermined charging voltage;

developing means for supplying a developing agent to said image carrier at a predetermined developing bias voltage;

optical means for radiating a light beam on said image carrier;

conductive transparent means arranged to face said image carrier, for transmitting the light beam from said optical means therethrough, said conductive transparent means being electrically connected to one of said charging means and said developing means; and voltage control means arranged between said conductive transparent means and said one of said charging means and said developing means, for controlling said voltage applied from said charging means to said conductive transparent means such that a voltage applied to said conductive transparent means reaches a predetermined voltage when a forward end of a charged region of said image carrier charged by said charging means reaches a position opposite to said optical means, and the voltage applied to said conductive transparent means reaches a voltage lower than the predetermined voltage when a terminal end of the charged region reaches the position opposite to said optical means.

* * * * *